US008714359B2

(12) United States Patent
Aizawa et al.

(10) Patent No.: US 8,714,359 B2
(45) Date of Patent: May 6, 2014

(54) ROTATING CLASSIFIER

(75) Inventors: Takashi Aizawa, Kure (JP); Akira Baba, Kure (JP); Yuki Kondo, Kure (JP); Yutaka Takeno, Kure (JP); Shinichiro Nomura, Kure (JP)

(73) Assignee: Babcock-Hitachi Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/698,001

(22) PCT Filed: May 11, 2011

(86) PCT No.: PCT/JP2011/060864

§ 371 (c)(1),
(2), (4) Date: Nov. 14, 2012

(87) PCT Pub. No.: WO2011/142390

PCT Pub. Date: Nov. 17, 2011

(65) Prior Publication Data

US 2013/0056396 A1 Mar. 7, 2013

(30) Foreign Application Priority Data

May 14, 2010 (JP) ..... 2010-112111
Apr. 27, 2011 (JP) ..... 2011-099614

(51) Int. Cl.
*B07B 7/01* (2006.01)

(52) U.S. Cl.
USPC ..... 209/142; 209/44.2; 209/143; 209/713

(58) Field of Classification Search
USPC ..... 209/44.2, 142, 143, 713; 241/24.24
See application file for complete search history.

(56) References Cited

U.S. PATENT DOCUMENTS

| | | | | |
|---|---|---|---|---|
| 2,754,967 | A * | 7/1956 | Lykken | 241/56 |
| 7,654,396 | B2 * | 2/2010 | Takeno et al. | 209/713 |
| 2007/0228194 | A1 * | 10/2007 | Takeno et al. | 241/24.24 |
| 2009/0294333 | A1 * | 12/2009 | Pistorius et al. | 209/44.2 |

FOREIGN PATENT DOCUMENTS

| | | | |
|---|---|---|---|
| JP | 59-44584 | U | 3/1984 |
| JP | 64-8982 | U | 1/1989 |
| JP | 7-51629 | A | 2/1995 |
| JP | 8-192066 | A | 7/1996 |
| JP | 2003-126782 | A | 5/2003 |
| JP | 2005-324104 | A | 11/2005 |

OTHER PUBLICATIONS

International Search Report dated Aug. 23, 2011 including English-language translation (Four (4) pages).

* cited by examiner

*Primary Examiner* — Terrell Matthews
(74) *Attorney, Agent, or Firm* — Crowell & Moring LLP

(57) ABSTRACT

[Problem] To provide a rotating classifier which can keep classification performance high and which can prevent blockages caused by biomass and the like.
[Means for Resolution] The rotating classifier is characterized in that: comb teeth-like protrusion portions protruding toward a fixed member side are provided on top of rotary classification fins at intervals along the circumferential direction of the rotating classifier fins; a first gap is provided between an upper end portion of each of the comb teeth-like protrusion portions and a lower surface of the fixed member; a second gap formed between a protrusion portion and a protrusion portion adjacent to the protrusion portion is connected to the first gap; and an air stream flowing from the radial outside to the radial inside of the comb teeth-like protrusion portions through the first gap and the second gap is formed due to the rotation of the rotary classification fins.

10 Claims, 17 Drawing Sheets

ROTATING CLASSIFIER

TECHNICAL FIELD

The present invention relates to a rotating classifier which classifies pulverized matter such as a simple biomass substance or a mixture of coal and biomass according to a predetermined size. Particularly, it relates to a rotating classifier in which passages of pulverized matter and blockages caused by the pulverized matter can be prevented so that classification performance is improved to make stable operation possible.

BACKGROUND ART

Because biomass fuel contains a low N content and a high volatile matter content, combustion with low NOx and low unburned combustibles emission can be achieved by mixed combustion or combined combustion of biomass and fossil fuel such as coal. A combustion technique using woody biomass as secondary fuel has recently attracted attention as one of measures to reduce $CO_2$ emissions in a fossil fuel combustion boiler.

There are a lot of conventional instances of the woody biomass mixed combustion technique particularly in Europe and North America. There is a method in which woody biomass is mixedly put into an existing coal pulverizer and pulverized and then put together with powdered coal into a boiler furnace from a burner. A method of feeding woody biomass onto a coal-carrying conveyor and mixing and pulverizing the woody biomass together with coal while using a pulverization combustion system in common with coal is generally used domestically in Japan because the cost thereof is lowest.

Pulverized and pelletized woody biomass or under-50 mm pulverized and chipped woody biomass is used as woody biomass on this occasion. As another example of mixed combustion, there is a technique of pulverizing woody biomass independently, feeding the woody biomass to a powdered coal carrying line, mixing the woody biomass with powdered coal and burning the mixture of the woody biomass and the powdered coal in a furnace.

Applicability of low water content and high energy density pellets or briquettes in place of woody chips as fuel for power generation has been discussed recently. This is because pellets or briquettes are not only low in transportation fee but also excellent in storability although the production cost of the pellets or briquettes as fuel is higher than that of pulverized green wood in terms of the cost of raw material production.

FIG. 22 is a schematic configuration view of a conventional roller type vertical pulverization device. The roller type vertical pulverization device is mainly constituted by a drive portion, a pressurization portion, a pulverization portion, and a classification portion.

The drive portion has a mechanism to transmit rotational force from a pulverization portion drive motor 1 placed outside the roller type pulverization device to a speed reducer 2 and transmitting the rotational force of the speed reducer 2 to a rotary table 3 placed on top of the speed reducer 2.

A pressurization frame 6 placed inside the roller type pulverization device is pulled down through a rod 5 by a hydraulic cylinder 4 placed outside the roller type pulverization device, so that the pressurization portion can apply a pulverization load to a bracket 7 paced at the bottom of the pressurization frame 6.

In the pulverization portion, pulverization rollers 8 disposed at circumferentially regular intervals on the rotary table 3 are supported by the pressurization frame 6 and the bracket 7. The pulverization rollers 8 rotate according to rotation of the rotary table 3, so that a pulverization target 10 put through a raw material feed pipe 9 is pulverized by nip portions between the rotary table 3 and the pulverization rollers 8.

The classification portion has a cyclone type fixed classifier 12 provided with fixed classification fins 11, and a rotating classifier 14 provided with rotary classification fins 13. A recovery cone 15 is attached to lower end portions of the fixed classification fins 11. As shown in the drawing, the rotating classifier 14 is disposed inside the fixed classifier 12 to thereby provide a double classification mechanism. The rotary classification fins 13 are driven to rotate by a classification motor 24 through a hollow rotary shaft 23 disposed on an outer circumference of the raw material feed pipe 9.

The pulverization target 10 such as coal put through the raw material feed pipe 9 falls down to a central portion of the rotating rotary table 3 and moves to the outer circumferential side of the rotary table 3 with a spiral locus drawn on the rotary table 3 by centrifugal force generated in accordance with the rotation of the rotary table 3, so that the pulverization target 10 is nipped and pulverized between the rotary table 3 and the pulverization rollers 8 rolling thereon.

The pulverized pulverization target 10 further moves to the outer circumference and meets with a carrying gas 18 such as high-temperature primary air introduced into a mill casing 17 from a throat 16 provided on the outer circumference of the rotary table 3, so that the pulverized matter is blown up while dried.

A section from the throat 16 to the lower end of the fixed classifier 12 is called primary classification portion. The blown-up pulverized matter 19 is classified by gravitation so that coarse particles fall down and are returned to the pulverization portion.

The fine pulverized matter 19 which has reached the classification portion is classified into fine particles 20 not larger than a predetermined particle size and coarse particles 21 larger than the predetermined particle size by the fixed classifier 12 and the rotating classifier 14 (secondary classification). The coarse particles 21 fall down along the inner surface of the recovery cone 15 and re-pulverized. On the other hand, the fine particles 20 are carried by an air flow to a destination such as a coal-fired boiler (not shown) via a feed pipe 22.

FIG. 23 is a partly enlarged schematic configuration view of the classification device provided in the conventional roller type pulverization device.

As shown in the drawing, the rotary classification fins 13 are disposed inside the fixed classification fins 11 and fixed and supported to a lower ring support 25 and an upper ring support 26 so that the rotary classification fins 13 are put between the two ring supports 25 and 26. The lower ring support 25 and the upper ring support 26 are connected to each other with a distance on the outer circumferential side of the rotary shaft 23 (see FIG. 22), so that the rotary classification fins 13, the lower ring support 25 and the upper ring support 26 rotate integrally with the rotary shaft 23.

The planar shape of each rotary classification fin 13 is rectangular. A large number of rotary classification fins 13 are set at regular intervals along the circumferential direction of the ring supports 25 and 26 so that the width direction of each rotary classification fin 13 faces the rotation center of the rotating classifier 14 (see FIG. 22).

A narrow gap (narrow portion 28) is formed between the upper ring support 26 and a top plate 27 provided above the upper ring support 26. The narrow portion 28 is a gap which is provided so that the upper ring support 26 is prevented from coming into contact with the top plate 27 even if the rotating classifier 14 rotates. If the narrow portion 28 is tall, that is, if the gap between the upper ring support 26 and the top plate 27 is large, there is a possibility that the coarse particles 21 may pass through the gap so as to be mixed with the classified fine particles 20. For this reason, it is impossible to make the narrow portion 28 too tall, so that the size of the gap (narrow portion 28) between the upper ring support 26 and the top plate 27 has to be set strictly to be several millimeters, compared with the upper ring support 26 (rotary classification fins 13) having a huge outer diameter.

CITATION LIST

Patent Literature

Patent Literature 1: U.S. Patent Application 2009/0294333A1
Patent Literature 2: JP-A-Hei-8-192066
Patent Literature 3: JP-A-2003-126782

SUMMARY OF INVENTION

Technical Problem

Originally, biomass does not need to be classified accurately by a rotating classifier because biomass which is even rough can be burned. However, it is necessary to set the particle size of biomass to be substantially equal to that of coal, that is, it is necessary to classify biomass accurately in accordance with coal in mixed pulverization of biomass and coal because coal also has to be burned in a boiler.

In order to perform accurate classification in this manner, the gap between the top plate 27 and the upper ring support 26 is important as described above. This is because the coarse particles 21 may pass through the gap so as to be mixed with the classified powdered coal 20.

This passing-through phenomenon is a phenomenon occurring due to the fact that a flow in the direction of rotation of the upper ring support 26 in the vicinity of the upper surface of the upper ring support 26 is generated between the upper ring support 26 and the top plate 27 but a flow toward the rotation center of the rotating classifier 14 is so dominant that the coarse particles 21 will go with the flow toward the rotation center and pass through the gap between the upper ring support 26 and the top plate 27.

Moreover, because biomass lighter in specific gravity than coal is easily blown up from the pulverization portion and fibrous, there is a problem that the narrow portion 28 between the top plate 27 and the upper ring support 26 is blocked with the biomass lying on top of one another so that rotation of the rotating classifier 14 is stopped by the blockage of the narrow portion 28. The problem of the blockage caused by biomass is a problem which needs to be solved in order to improve the mixed pulverization ratio of biomass to coal.

There is heretofore no way but to enlarge the narrow portion 28 between the top plate 27 and the upper ring support 26 to prevent the narrow portion 28 from being blocked with biomass. However, if the narrow portion 28 is enlarged, passing-through of coarse coal particles increases so remarkably that the particle size distribution of the particle group taken out from the pulverization device is not sharp because of inaccurate classification. As a result, there is a problem that combustion performance of the boiler device becomes so worse that NOx, UBC, etc. increase and power generation efficiency decreases.

Moreover, a structure in which downflow forming members 30 shaped cylindrically are hung down between the fixed classification fins 11 and the rotary classification fins 13 from the lower surface of the top plate 27 as shown in FIGS. 22 and 23 has been heretofore proposed in order to improve the classification effect in this type pulverization device.

When the downflow forming members 30 are hung down between the fixed classification fins 11 and the rotary classification fins 13 in this manner, the pulverized matter (particle group) 19 blown up from below by the carrying gas 18 spouted out from the throat 16 moves up to the vicinity of the top plate 27 by inertial force, passes through the fixed classification fins 11 and collides with the downflow forming members 30, as shown in FIG. 23.

Although the pulverized matter (particle group) 19 is formed as a downflow due to its own weight etc. after the collision, the flow of the particle group 31 except the coarse particles 21 is changed to a flow toward the rotary classification fins 13 by the negative pressure on the feed pipe 22 (see FIG. 22) side in the vicinity of the lower end of each downflow forming member 30. However, the coarse particles 21 in the downflow are separated from the flow toward the rotary classification fins 13 so as to fall down along the recovery cone 15 (see FIG. 22) because the coarse particles 21 are large in gravity and downward inertial force.

As a result, the particle group 31 little containing coarse particles 21 reaches the rotary classification fins 13, so that the classification effect can be improved.

However, when coal and biomass are mixed and pulverized (subjected to mixed pulverization) by the pulverization device having the configuration, vortex flows 33 containing much pulverized matter of biomass are apt to be formed in space portions 32 formed between the upper end portions of the rotary classification fins 13 and the downflow forming members 30 in the vicinity of the top plate 27 as shown in FIG. 23 because biomass is lighter than coal.

When the vortex flows 33 containing much pulverized matter of biomass are formed in the space portions 32, the blockage of the narrow portion 28 with biomass is apt to occur inevitably. There arises a new problem that rotation of the rotating classifier 14 is stopped.

FIG. 24 is a schematic configuration view of the classifier which has heretofore proposed in JP-A-2003-126782 (the aforementioned Patent Literature 3). FIG. 25 is a partly cutaway enlarged perspective view showing important part of the classifier.

The classifier shown in FIG. 24 is placed above a pulverization portion (not shown) having a rotary table and pulverization rollers.

A raw material feed pipe 102 is placed vertically so as to pass through a central portion of a classification chamber 101 formed inside the classifier. A lower end portion of the raw material feed pipe 102 extends to the vicinity of the rotary table. An induced air blower 104 is connected to an upper portion of the classification chamber 101 through a duct 103.

Fixed classification fins 106 shaped cylindrically are attached to the lower surface of an outer circumferential portion of a top plate 105 placed in the middle stage of the classification chamber 101. A recovery cone 107 is further attached to the lower end portions of the fixed classification fins 106.

A cage-like rotating classifier 108 is placed from below a central opening portion of the top plate 105 to the circumference of the raw material feed pipe 102.

As shown in FIG. 25, the rotating classifier 108 has an annular lower ring support 109, an upper ring support 110, flat plate-like rotary classification fins 111 disposed at regular intervals along the circumferential direction of the ring supports 109 and 110, flat plate-like coarse powder intrusion preventing blades 112 disposed on top of the rotary classification fins 111, an inner pipe 113 idly fitted to the raw material feed pipe 102, and connector bars 114 for connecting the upper ring support 110 and the inner pipe 113 to each other. The rotating classifier 108 is driven to rotate by a not-shown classification motor.

Lower end portions and upper end portions of the rotary classification fins 111 are supported and fixed by the lower ring support 109 and the upper ring support 110. Lower end portions of the coarse powder intrusion preventing blades 112 are supported and fixed by the upper ring support 110.

The width direction of each of the rotary classification fins 111 faces the rotation center of the rotating classifier 108. On the other hand, the width direction of each of the coarse powder intrusion preventing blades 112 is disposed so as to be slightly inclined with respect to the rotary classification fin 111 in order to form a blowout air flow 115 which will be described later.

As shown in FIG. 25, the height of the coarse powder intrusion preventing blade 112 is set so that a predetermined gap is formed between the upper end of each coarse powder intrusion preventing blade 112 and the top plate 105. An inner blocking wall 116 shaped cylindrically is disposed downward in an inner circumferential end portion of the top plate 105 so that a predetermined gap is formed between the inner blocking wall 116 and the inner circumferential side of the coarse powder intrusion preventing blades 112.

An outer blocking wall 117 shaped cylindrically is disposed downward from the top plate 105 on the outer circumferential side of the coarse powder intrusion preventing blades 112 so that a predetermined gap is formed between the outer blocking wall 117 and the outer circumferential side of the coarse powder intrusion preventing blades 112. A lower end portion of the outer blocking wall 117 extends to the upper end portions of the rotary classification fins 111 beyond the coarse powder intrusion preventing blades 112.

Accordingly, the coarse powder intrusion preventing blades 112 are surrounded by the inner circumferential end portion of the top plate 105, the inner blocking wall 116 and the outer blocking wall 117. Each of the gap between the coarse powder intrusion preventing blades 112 and the top plate 105, the gap between the coarse powder intrusion preventing blades 112 and the inner blocking wall 116 and the gap between the coarse powder intrusion preventing blades 112 and the outer blocking wall 117 is set at about 20-30 mm.

Vertical slits 117 are formed circumferentially in the inner blocking wall 116.

When air in the classification chamber 101 is removed by the induced air blower 104, outside air flows into a mill casing 119 from a wind box of a pulverization portion (not shown) and flows into the classification chamber 101 from the fixed classification fins 106 while accompanied by the particle group pulverized in the pulverization portion. On this occasion, relatively large coarse particles which intend to flow into the classification chamber 101 are separated by the cyclone effect of the fixed classification fins 106 and returned to the pulverization portion.

The particle group introduced into the classification chamber 101 is further classified by centrifugal force of the rotary classification fins 108, so that particles relatively large in particle size fall down onto the recovery cone 107 and returned to the pulverization portion whereas fine particles passing through the rotary classification fins 108 are taken out from the classifier.

As described above, the coarse powder intrusion preventing blades 112 are surrounded downward concavely by the inner circumferential end portion of the top plate 105, the inner blocking wall 116 and the outer blocking wall 117 through a gap of about 20-30 mm. Moreover, each coarse powder intrusion preventing blade 112 is disposed so as to be slightly inclined with respect to the direction of rotation of the rotating classifier 108.

For this reason, the structure is provided in such a manner that, when the coarse powder intrusion preventing blades 112 rotate together with the rotary classification fins 108, radially outward force from the inside to the outside of the rotating classifier 108 is generated so that air passes through the concave gap (the gap between the coarse powder intrusion preventing blades 112 and the inner blocking wall 116→the gap between the coarse powder intrusion preventing blades 112 and the top plate 105→the gap between the coarse powder intrusion preventing blades 112 and the outer blocking wall 117) via the vertical slits 118 of the inner blocking wall 116 to thereby form the blowout air flow 115 blowing out from the lower end of the outer blocking wall 117 to prevent coarse powder from intruding from between the top plate 105 and the rotating classifier 108, as shown in FIG. 25.

As described above, the mechanism is provided in such a manner that, when air in the classification chamber 101 is removed by the induced air blower 104 while the pulverization device operates, outside air is introduced into the mill casing 119 from the wind box so that an air flow generated thus carries the particle group pulverized in the pulverization portion to the upper classifier. Air in the classification chamber 101 is always removed by powerful sucking force of the induced air blower 104.

Under such a condition, the blowout air flow 115 going against the powerful air flow generated by the sucking force of the induced air blower 104 cannot be formed substantially only by the rotation of the coarse powder intrusion preventing blades 112. For this reason, it is impossible to expect the coarse particle intrusion preventing effect.

Even if it is possible to form the blowout air flow 115, there is a disadvantage that rotation of the rotating classifier 108 is stopped when a mixture of biomass and coal is pulverized by this pulverization device because biomass is so fibrous that the anfractuous concave gap (the gap between the coarse powder intrusion preventing blades 112 and the inner blocking wall 116, the gap between the coarse powder intrusion preventing blades 112 and the top plate 105 and the gap between the coarse powder intrusion preventing blades 112 and the outer blocking wall 117) is blocked with biomass while biomass passes through the gap via the vertical slits 118 of the inner blocking wall 116.

In JP-A-Hei-8-192066 (the aforementioned Patent Literature 2), a rotating classifier having the following configuration has been heretofore proposed in order to prevent coarse particles from being short-passed to a fine particle outlet.

The rotating classifier has a structure in which a seal air feed hole and an annular seal air outflow groove communicating with the seal air feed hole are provided in the top plate and an air source for feeding pressure air and the seal air feed hole are connected by a flexible tube in order to feed seal air to a gap between a rotary blade and a fixed blade guide in the classifier.

The mechanism is provided in such a manner that seal air (pressure air) from the air source is spouted out from a seal air outflow groove to the gap between the rotary blade and the blade guide via the flexible tube and the seal air feed hole to thereby reject short-passing of coarse particles to the fine particle outlet through the gap.

However, the rotating classifier has a disadvantage that the rotating classifier requires an excessive space and brings a large size and a high cost because the air source for feeding pressure air, the flexible tube, a regulating valve for controlling feeding of seal air, etc. are additionally provided to the outside of the rotating classifier.

An object of the invention is accomplished on such a background and is to provide a rotating classifier which can keep classification performance high and which can prevent blockages caused by biomass and the like.

Solution to Problem

To achieve the foregoing object, a subject of a first means according to the invention is a rotating classifier including:

a classifier motor;

a rotary shaft which is disposed vertically and driven to rotate by the classifier motor;

a fixed member which is disposed horizontally so that the rotary shaft passes through the fixed member;

support members which are shaped annularly in plan view and disposed below the fixed member and at a distance radially outside the rotary shaft;

a large number of rotary classification fins which are fixed to the support members at intervals in a circumferential direction of the support members; and connection members which connect the rotary classification fins to the rotary shaft, the rotary classification fins being rotated by the classifier motor so that a particle group carried by an air flow is classified by centrifugal force of the rotary classification fins.

It is characterized in that:

comb teeth-like protrusion portions which protrude toward the fixed member side at intervals along a circumferential direction of the rotary classification fins are provided on top of the rotary classification fins;

a first gap is provided between an upper end portion of each of the protrusion portions and a lower surface of the fixed member;

a coarse particle passage suppression ring is attached to the lower surface of the fixed member and located radially outside the protrusion portions so that the protrusion portions are surrounded by the coarse particle passage suppression ring;

the ratio (Hb/Ha) of Hb to Ha is set to be not larger than 0.2 when Ha is the height of each protrusion portion and Hb is the height of the first gap; and the ratio (Hc/Ho) of Hc to Ho is set to be not smaller than 1.4 when Ho is the length from the lower surface of the fixed member to a lower surface of the coarse particle passage suppression ring and Hc is the height from a lower end of each protrusion portion to the lower surface of the fixed member.

A second means according to the invention is the first means characterized in that:

the ratio (Hb/Ha) is set to be not larger than 0.1, and the ratio (Hc/Ho) is set to be not smaller than 2.

A third means according to the invention is the first means or the second means characterized in that:

the protrusion portions are formed by extending the rotary classification fins toward the fixed member side;

the rotary classification fins are connected and fixed to one another by a lower annular support member disposed in a position corresponding to a lower portion of each of the rotary classification fins and an upper annular support member disposed above the lower annular support member; and cut-in grooves or through-holes are formed in the upper annular support member so that upper portions of the rotary classification fins are connected and fixed to one another by the upper annular support member through the cut-in grooves or through-holes.

A fourth means according to the invention is the third means characterized in that:

the protrusion portions are formed from the upper annular support member and a large number of upper fins provided so as to be erected from the upper annular support member toward the fixed member side, or formed by forming a large number of groove portions in an upper portion of the upper annular support member; and a width direction of each rotary classification fin is inclined with respect to a virtual line connecting a radially inner end of the rotary classification fin and a rotation center of the rotating classifier to each other so that a radially outer end of the rotary classification fin is separated from the virtual line, and a width direction of each of the upper fins or protrusive stripes formed between the groove portions on the upper annular support member faces the rotation center of the rotating classifier.

A subject of a fifth means according to the invention is a rotating classifier including:

a classifier motor;

a rotary shaft which is disposed vertically and driven to rotate by the classifier motor;

a fixed member which is disposed horizontally so that the rotary shaft passes through the fixed member;

support members which are shaped annularly in plan view and disposed below the fixed member and at a distance radially outside the rotary shaft;

a large number of rotary classification fins which are fixed to the support members at intervals in a circumferential direction of the support members; and connection members which connect the rotary classification fins to the rotary shaft, the rotary classification fins being rotated by the classifier motor so that a particle group carried by an air flow is classified by centrifugal force of the rotary classification fins; characterized in that:

comb teeth-like protrusion portions which protrude toward the fixed member side at intervals along a circumferential direction of the rotary classification fins are provided on top of the rotary classification fins;

a first gap is provided between an upper end portion of each of the protrusion portions and a lower surface of the fixed member;

a second gap formed between each of the protrusion portions and another protrusion portion adjacent to the protrusion portion is connected to the first gap;

a turning-direction velocity component having the same direction as a direction of rotation of the rotary classification fins is added to an air stream flowing in gaps of the protrusion portions through the first gap and the second gap due to rotation of the rotary classification fins;

the annular support members have a lower annular support member which connects and fixes lower portions of the rotary classification fins to one another, and an upper annular support member which is disposed above the lower annular support member and connects and fixes the rotary classification fins to one another; and the protrusion portions are formed by forming a large number of groove portions in an upper portion of the upper annular support member.

A sixth means according to the invention is the fifth means characterized in that:

the groove portions on the upper annular support member are formed by cutting in the upper portion of the upper annular support member.

A seventh means according to the invention is the fifth means characterized in that:

the groove portions on the upper annular support member are formed by cutting and raising part of the upper annular support member.

An eighth means according to the invention is the fifth means characterized in that:

the protrusion portions are interchangeably attached to a body of the rotating classifier.

Advantageous Effects of Invention

The invention is configured as described above and can provide a rotating classifier which can keep classification performance high and which can prevent blockages caused by biomass and the like.

DESCRIPTION OF EMBODIMENTS

Embodiments of the invention will be described below with reference to the drawings.

(First Embodiment)

Figure 1:
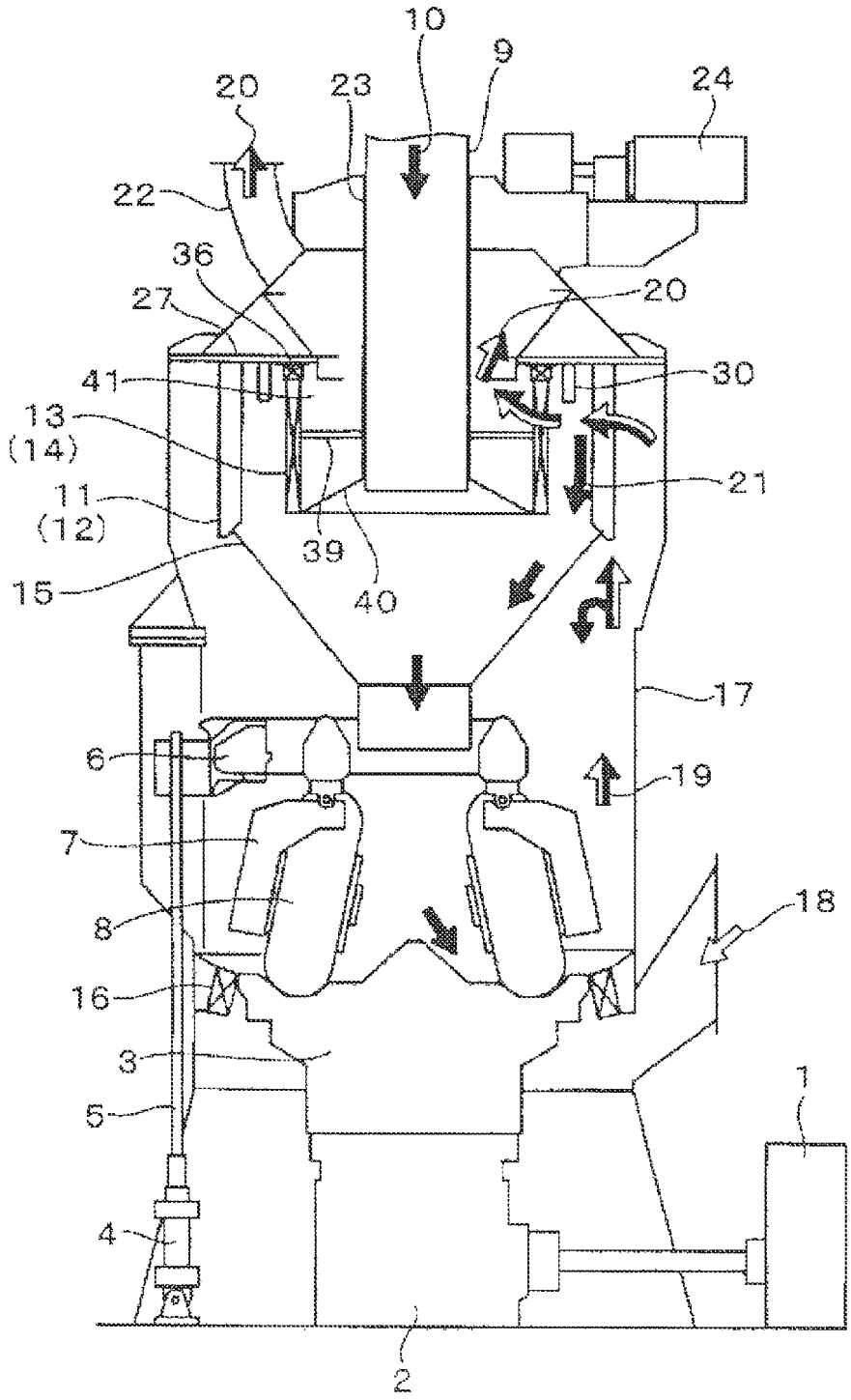
[FIG. 1] A schematic configuration view of a vertical pulverization device according to a first embodiment of the invention.
Figure 2:
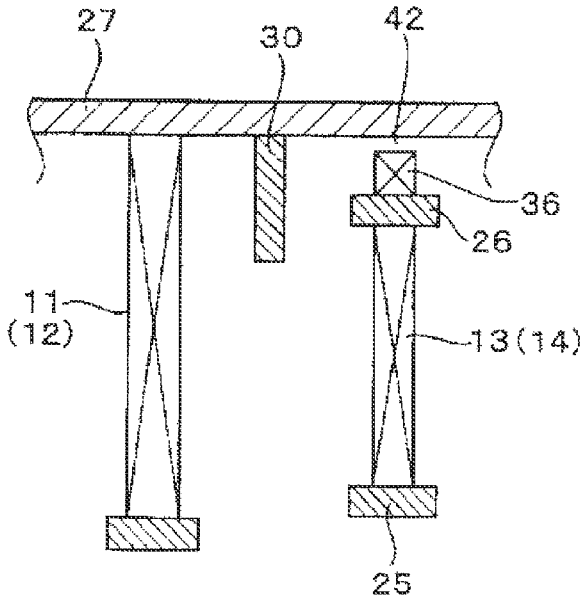
[FIG. 2] A partly enlarged schematic configuration view of a classification device used in the vertical pulverization device.
Figure 3:
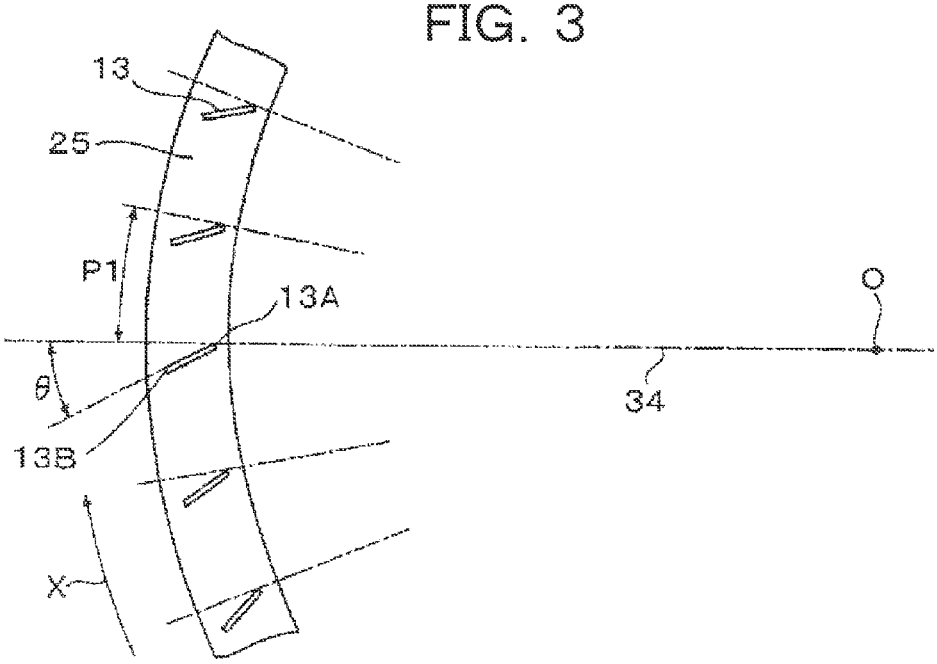
[FIG. 3] A partly enlarged plan view of rotary classification fins in the classification device.
Figure 4:
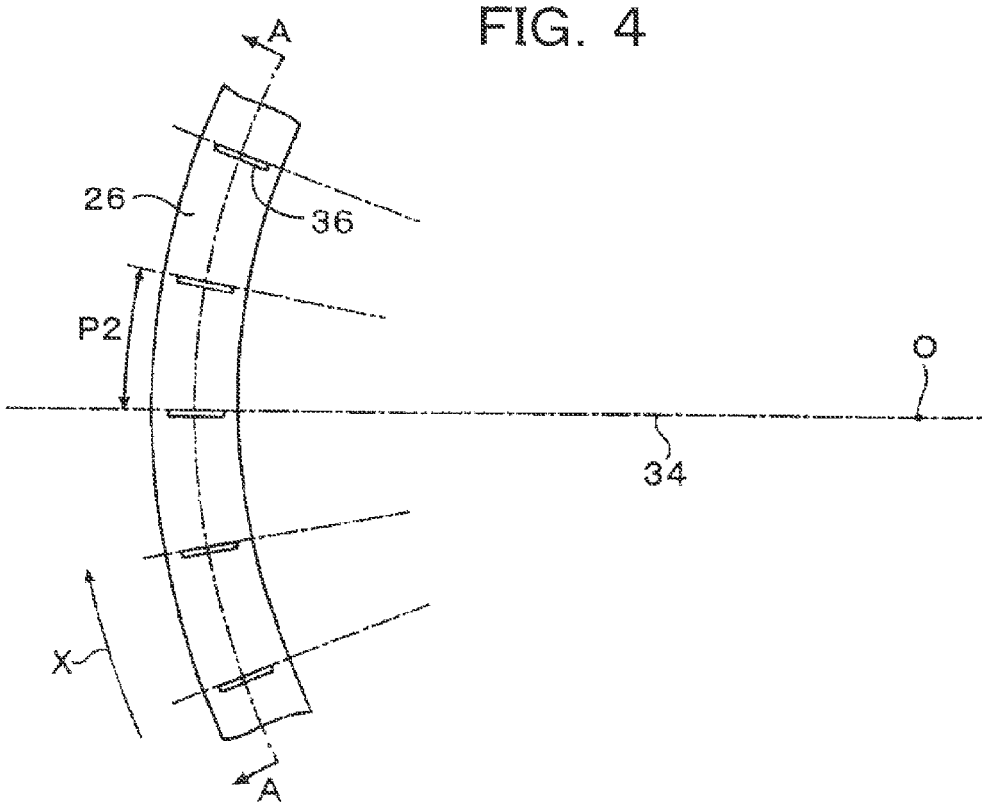
[FIG. 4] A partly enlarged plan view of upper fins in the classification device.
Figure 5:
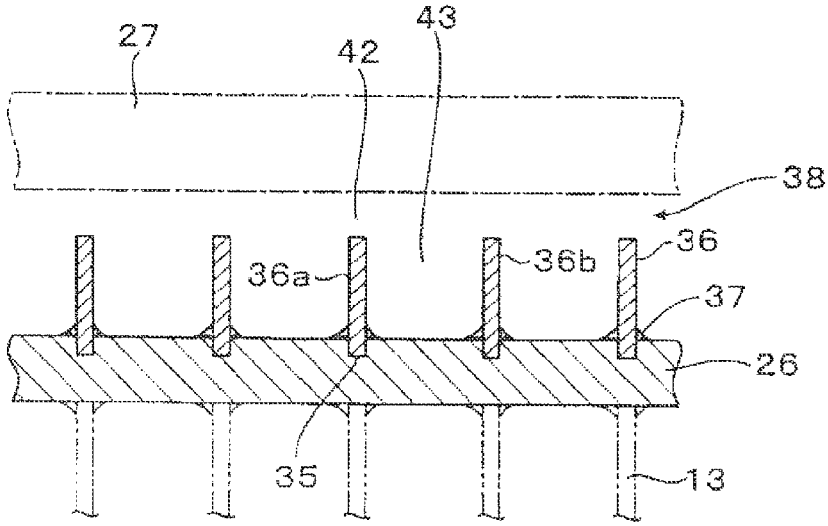
[FIG. 5] A sectional view taken along the line A-A in FIG. 4.

FIG. 1 is a schematic configuration view of a vertical pulverization device according to a first embodiment of the invention. FIG. 2 is a partly enlarged schematic configuration view of a classification device used in the vertical pulverization device. FIG. 3 is a partly enlarged plan view of rotary classification fins in the classification device. FIG. 4 is a partly enlarged plan view of upper fins in the classification device. FIG. 5 is a sectional view taken along the line A-A in FIG. 4.

Figure 22:
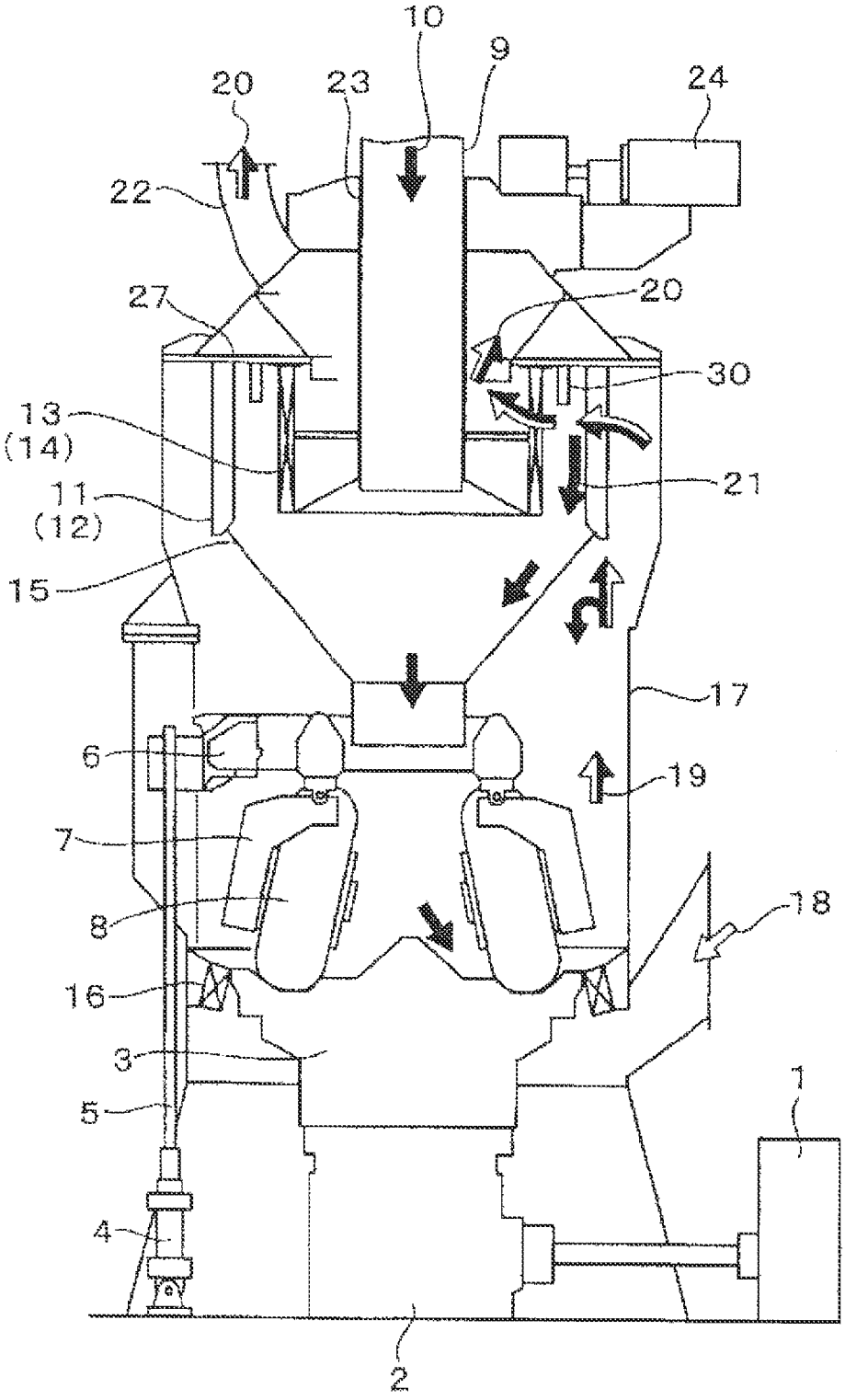
[FIG. 22] A schematic configuration view of a conventional vertical pulverization device.

The vertical pulverization device according to the embodiment of the invention shown in FIG. 1 is different from a conventional vertical pulverization device shown in FIG. 22 in the configuration concerned with a rotating classifier 14 while the other configuration is substantially the same as that of the conventional vertical pulverization device. Accordingly, duplicate description thereof will be omitted.

Incidentally, the sign 39 in FIG. 1 designates a plurality of connector bars placed around a rotary shaft 23 in order to connect rotary classification fins 13 to the rotary shaft 23; and 40, a blocking plate which blocks a gap between a lower opening end of each rotary classification fin 13 and a lower opening end of the rotary shaft 23 to thereby form a classification chamber 41 inside the rotary classification fins 13.

As shown in FIG. 2, the rotary classification fins 13 are disposed inside fixed classification fins 11. In the case of this embodiment, downflow forming members 30 shaped cylindrically are hung down from a top plate 27 in nearly middle positions between the fixed classification fins 11 and the rotary classification fins 13.

Each rotary classification fin 13 is made of a rectangular flat plate and extends vertically substantially in parallel to the rotary shaft 23 as shown in FIG. 1. The rotary classification fins 13 are fixed and supported to a lower ring support 25 and an upper ring support 26 each having an annular planar shape by welding or the like so that the rotary classification fins 13 are put between the two ring supports 25 and 26.

As shown in FIG. 3, the rotary classification fins 13 are disposed at regular intervals along the circumferential direction of the lower ring support 25 (upper ring support 26). Each rotary classification fin 13 is attached while inclined with respect to a virtual line 34 connecting an inner end portion 13A of the rotary classification fin 13 and a rotation center O of the rotating classifier 14 to each other so that an outer end portion 13B of the rotary classification fin 13 is located on a slightly wake flow side of a rotating direction X of the rotating classifier 14. The angle θ of inclination of the rotary classification fin 13 is determined based on results of various classification tests. In this embodiment, the inclination angle θ is set in a range of 15-45 degrees, preferably 20-40 degrees.

As shown in FIG. 5, a large number of attachment grooves 35 are formed at regular intervals along the circumferential direction in the upper portion of the upper ring support 26. Lower portions of upper fins 36 each made of a flat plate are fitted into the attachment grooves 35 and fixed by welding 37 so that the upper fins 36 protrude outward from the upper surface of the upper ring support 26. As shown in the drawing, comb teeth-like protrusion portions 38 are formed from the upper ring support 26 and the large number of upper fins 36 provided so as to be erected from the upper ring support 26.

As shown in FIG. 4, the upper fins 36 are disposed radially on the upper ring support 26 with the rotation center O of the rotating classifier 14 as its center.

In the case of this embodiment, as shown in FIGS. 3 and 4, the pitch P2 of the upper fins 36 is equalized to the pitch P1 of the rotary classification fins 13 (P1=P2). It is however possible to make the pitch P2 of the upper fins 36 narrower than the pitch P1 of the rotary classification fins 13 (P1>P2) or conversely make the pitch P2 of the upper fins 36 wider than the pitch P1 of the rotary classification fins 13 (P1<P2).

When the pitch P2 of the upper fins 36 is equalized to the pitch P1 of the rotary classification fins 13 (P1=P2) as described above, improvement in production efficiency can be attained because it is suitable to integral production of the rotary classification fins 13 and the upper fins 36.

When the pitch P2 of the upper fins 36 is made narrower than the pitch P1 of the rotary classification fins 13 (P1>P2), the particle passage preventing effect is large because turning force given to air in the space (gaps) from the upper fins 36 becomes strong.

When the pitch P2 of the upper fins 36 is made wider than the pitch P1 of the rotary classification fins 13 (P1<P2), there is an advantage that, for example, it is possible to attain cost reduction because it is easy to attach or process the upper fins 36 and groove portions 46 which will be described later.

In the case of this embodiment, as shown in FIG. 4, the upper fins 36 are disposed radially with the rotation center O of the rotating classifier 14 as its center. It is however possible to provide the upper fins 36 inclined in the same manner as the rotary classification fins 13 shown in FIG. 3.

As shown in FIGS. 2 and 5, a first gap 42 of about several millimeters is provided between the lower surface of the top plate 27 and the upper end portion of each upper fin 36 so that the comb teeth-like protrusion portions 38 are prevented from coming into contact with the top plate 27 when the rotating classifier 14 rotates. A second gap 43 formed between one upper fin 36*a* and another upper fin 36*b* adjacent thereto is connected to the first gap 42. The first and second gaps 42 and 43 are connected in the form of concaves and convexes as a whole (see FIG. 5).

In the rotating classifier 14 according to this embodiment, rotation driving force of a classification motor 24 shown in FIG. 1 is transmitted to the rotary shaft 23 and further transmitted to the rotary classification fins 13 and the upper fins 36 through the connector bars 39 and the blocking plate 40, so that the upper fins 36 rotate integrally with the rotary classification fins 13. A turning-direction velocity component having the same direction as the rotation direction of the rotary classification fins 13 is added to an air stream flowing in the gaps of the upper fins 36 (comb teeth-like protrusion portions 38) via the first gap 42 and the second gap 43 due to rotation of the upper fins 36 (comb teeth-like protrusion portions 38).

Figures 6A, 6B:
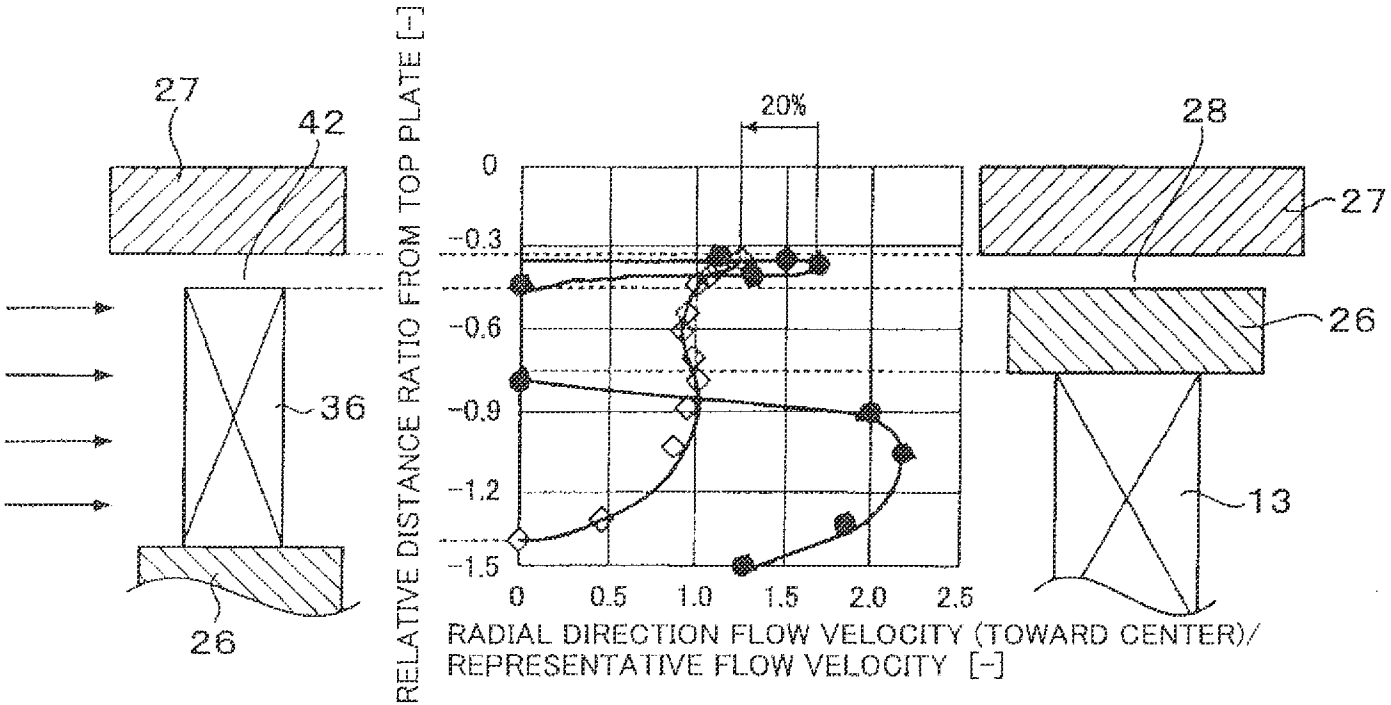
[FIG. 6] A flow analytic characteristic graph showing flow analysis of air flowing from the radial outside to the radial inside of each rotating classifier between an upper ring support and a top plate in a rotating classifier (a) according to this embodiment and a conventional rotating classifier (b).
Figure 23:
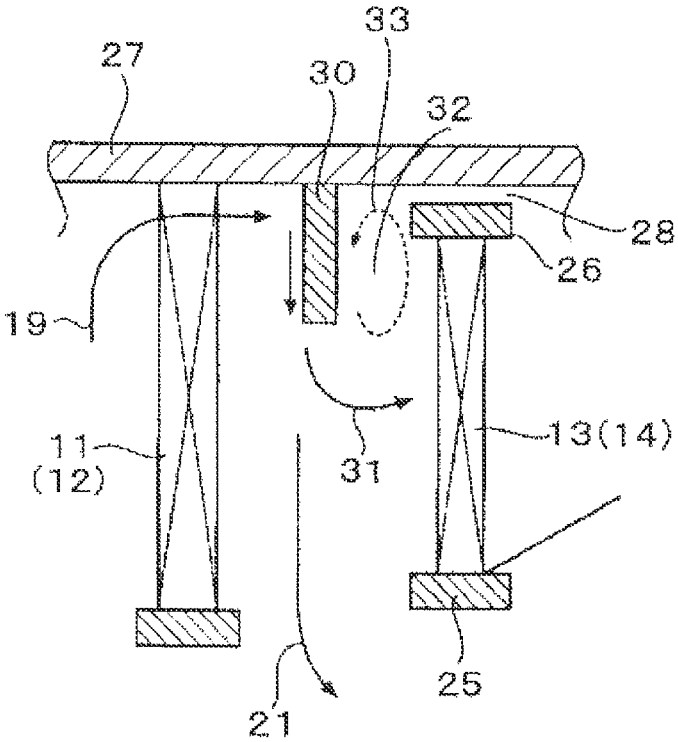
[FIG. 23] A partly enlarged schematic configuration view of a classification device provided in the vertical pulverization device.
Figure 24:
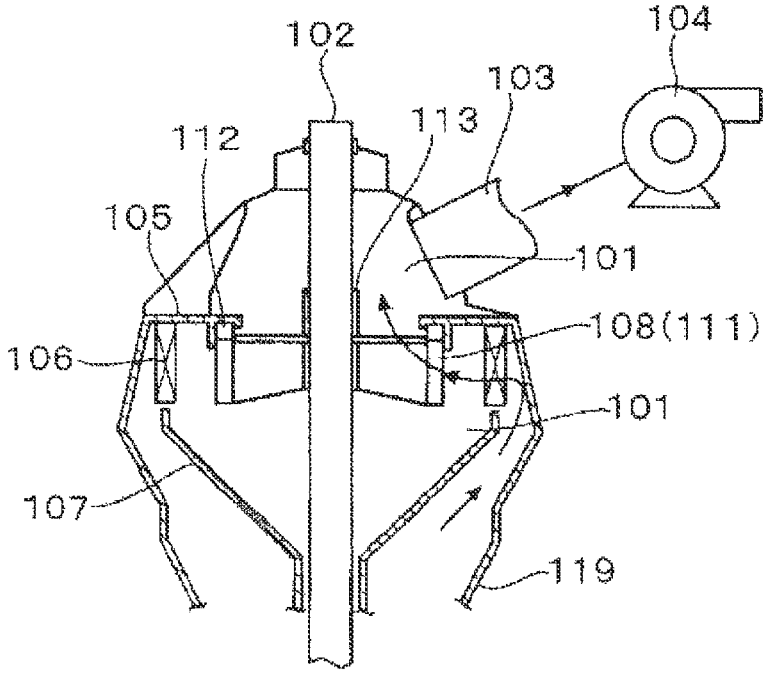
[FIG. 24] A schematic configuration view of a classifier which has been heretofore proposed.
Figure 25:
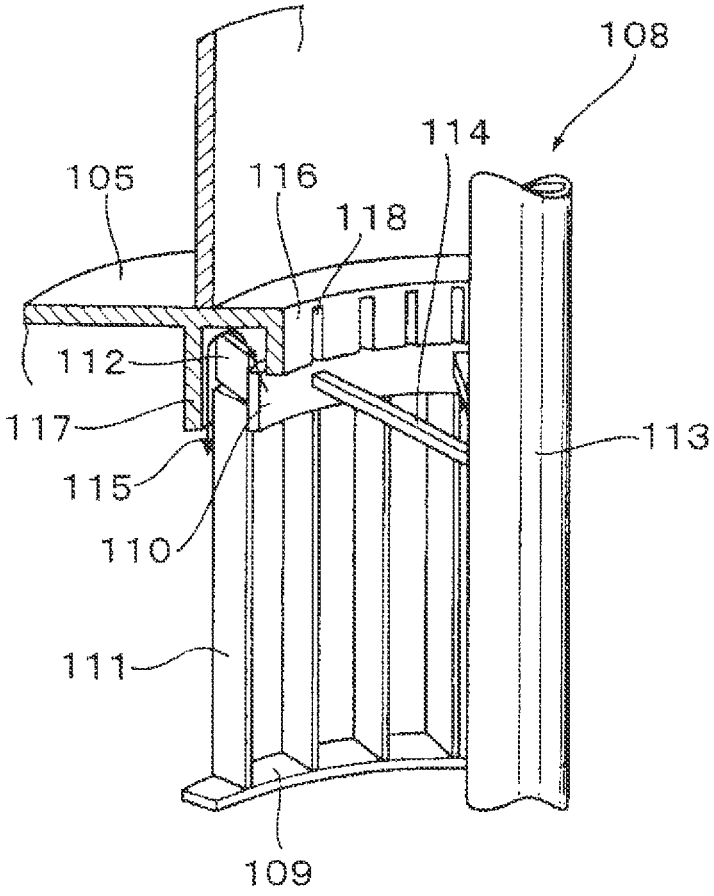
[FIG. 25] A partly cutaway enlarged perspective view of important part of the classifier.

FIG. 6 is a flow analytic characteristic graph showing flow analysis of air flowing from the radial outside to the radial inside of each rotating classifier 14 as represented by the arrow between the upper ring support 26 and the top plate 27 in the rotating classifier (a) according to this embodiment and the conventional rotating classifier (b) shown in FIG. 23.

In this drawing, the vertical axis expresses a relative distance ratio from the upper surface of the top plate 27 to the upper surface of the upper ring support 26 according to this embodiment, and the horizontal axis expresses a value obtained by nondimensionalizing the flow velocity of air flowing in the radial direction of the rotating classifier 14 between the upper ring support 26 and the top plate 27 with a representative flow velocity.

In this drawing, the rhombic mark expresses flow analytic characteristic of the rotating classifier (a) according to this embodiment, and the black circle mark expresses flow analytic characteristic of the conventional rotating classifier (b).

As is obvious from this drawing, the conventional rotating classifier 14 designated by the black circle mark has a tendency toward forced occurrence of passage of pulverized matter in a narrow portion 28 formed between the planar top plate 27 and the planar upper ring support 26 because the planar top plate 27 and the planar upper ring support 26 oppose to each other so that the velocity of air flowing in the narrow portion 28 becomes high.

On the contrary, in the rotating classifier 14 according to this embodiment designated by the rhombic mark, the first gap 42 is formed between the lower surface of the top plate 27 and the upper end portion of each upper fin 36 but the area of the upper surface of the upper fin 36 formed by erecting a plate material is very small compared with the area of the upper ring support 26 in the conventional rotating classifier 14. Moreover, as shown in FIG. 5, both sides of the first gap 42 are connected to the large second gap 43. Accordingly, as shown in FIG. 6, the flow velocity in the radial direction in the first gap 42 can be reduced by about 20% compared with the conventional case.

When the flow velocity in a place where pulverized matter is apt to pass through is reduced structurally in this manner, there is an effect of suppressing passage of pulverized matter.

Figure 7A:
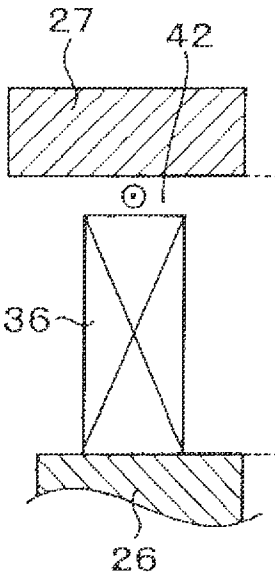
[FIG. 7] A flow analytic characteristic graph showing flow analysis of air flowing in a rotating direction (turning direction) of each rotating classifier between an upper ring support and a top plate in the rotating classifier (a) according to this embodiment and a rotating classifier (c) as a comparative example.
Figure 7C:
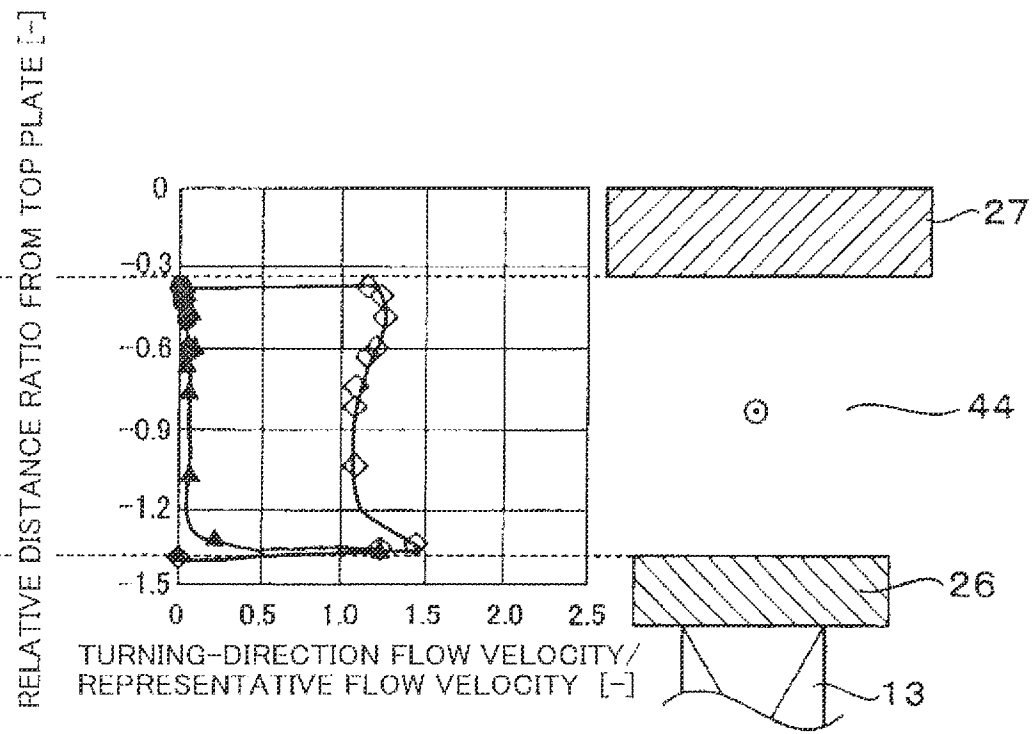

FIG. 7 is a flow analytic characteristic graph showing flow analysis of air flowing in a rotating direction (turning direction) of each rotating classifier 14 between the upper ring support 26 and the top plate 27 in the rotating classifier (a) according to this embodiment and a rotating classifier (c) as a comparative example. The circle mark with a central dot shown in (a) and (c) expresses a direction of an air stream flowing in the rotating direction of the rotating classifier 14 (direction perpendicular to the paper surface).

As shown in this drawing, in the rotating classifier (c) as a comparative example, the upper ring support 26 is provided in a position at the same distance from the top plate 27 as in the rotating classifier (a) according to this embodiment, so that a relative large space portion 44 is formed between the upper ring support 26 and the top plate 27.

In FIG. 7, the vertical axis expresses a relative distance ratio from the upper surface of the top plate 27 to the upper surface of the upper ring support 26, and the horizontal axis expresses a value obtained by nondimensionalizing the flow velocity of air flowing in the rotating direction of the rotating classifier 14 between the upper ring support 26 and the top plate 27 with a representative flow velocity.

In this drawing, the rhombic mark expresses flow analytic characteristic of the rotating classifier (a) according to this embodiment, and the black triangle mark expresses flow analytic characteristic of the rotating classifier (c) according to the comparative example.

As is obvious from this drawing, in the rotating classifier (c) as the comparative example designated by the black triangle mark, an air stream flowing in the rotating direction of the rotating classifier 14 little occurs because there is nothing between the upper ring support 26 and the top plate 27 so that a relatively large space portion 44 is formed.

On the contrary, in the rotating classifier (a) according to this embodiment designated by the rhombic mark, the plane of each upper fin 36 faces in a direction perpendicular to the rotating direction of the rotating classifier (a), so that the air between the upper fins 36 moves in the rotating direction with the rotation of the upper fins 36 to thereby generate an air flow in the turning direction. The air flow in the turning direction is a flow in a direction perpendicular to the direction of passage of pulverized matter and has an effect of suppressing the passage of pulverized matter.

In the rotating classifier 14 according to this embodiment, as shown in FIG. 5, blockages of biomass pulverized matter can be prevented effectively because of the fact that a large number of upper fins 36 are provided in a row so as to be erected from the upper surface of the upper ring support 26 to thereby form comb teeth-like protrusion portions 38 as a whole, and due to centrifugal force generated according to the rotation of the upper fins 36.

Figure 8:
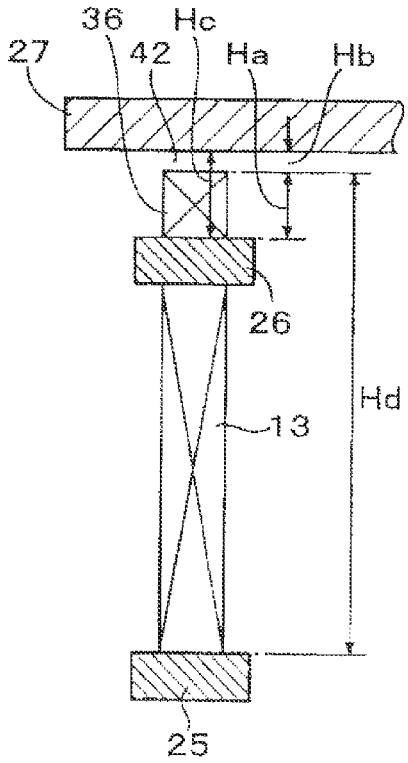
[FIG. 8] A view for explaining a proper ratio of the height of a first gap to the height of each upper fin in this embodiment.
Figure 9:
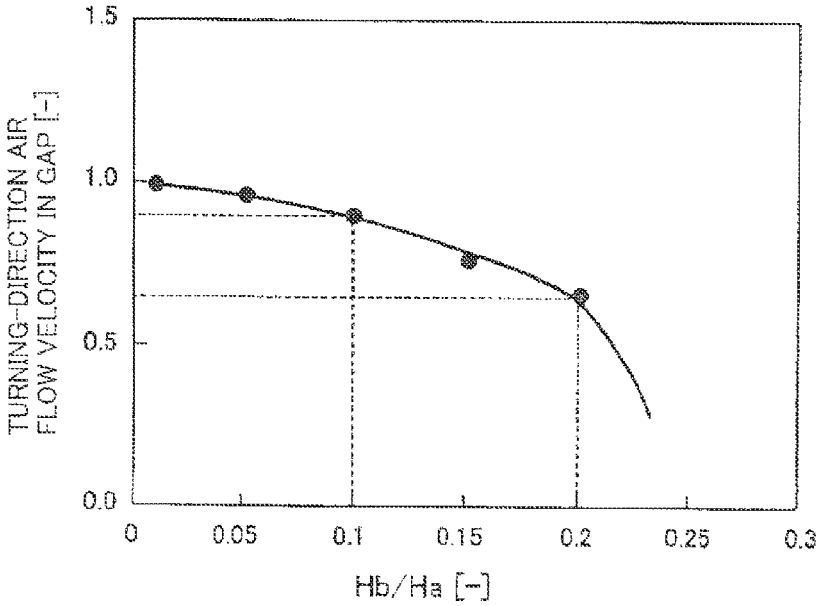
[FIG. 9] A characteristic graph showing the relationship between Hb/Ha and the velocity of an air flow in a turning direction generated in the first gap in this embodiment.

FIGS. 8 and 9 are views for explaining a proper ratio of the height of the first gasp 42 to the height of the upper fins 36 in this embodiment. Incidentally, this test is analysis of the flow of only air. This test is performed in the condition that the downflow forming members 30 are provided.

The respective signs shown in FIG. 8 are defined as follows.

Ha: the height of each upper fin 36

Hb: the height of the first gap 42

Hc: the height of each opening portion from the upper surface of the upper ring support 26 to the lower surface of the top plate 27 (the height from the lower end of the upper fin 36 to the lower surface of the top plate 27)

Hd: the height from the upper surface of the lower ring support 25 to the upper end surface of the upper fin 36

In FIG. 9, the horizontal axis in FIG. 9 expresses the ratio (Hb/Ha) of the height Hb of the first gap 42 to the height Ha of each of the upper fins 36, and the vertical axis expresses the ratio of the turning-direction air flow velocity component (spatial average) generated in the first gap 42 to the turning-direction moving velocity (peripheral velocity) of the upper fins 36.

As shown in this drawing, the turning-direction air flow velocity component generated in the gap 42 is substantially equalized to the peripheral velocity of the upper fins 36 (substantially equal to 1) as Hb/Ha approaches zero. Accordingly, the turning-direction flow velocity component is added to particles passing through the gap 42, so that centrifugal force is generated. That is, the passage of particles in the gap 42 hardly occurs.

On the other hand, as Hb/Ha increases, the turning-direction air flow velocity component in the gap 42 decreases slowly. When Hb/Ha becomes larger than 0.2, the air flow velocity component decreases rapidly. That is, when Hb/Ha>0.2, the rate of coarse particles mixed with product fine powder increases so rapidly that classification performance is lowered.

From the aforementioned description, it is necessary to set Hb/Ha to be not larger than 0.2 (Hb/Ha≤0.2) in order to suppress the passage of coarse particles in the gap 42. It is further preferable that Hb/Ha is set to be not larger than 0.1 (Hb/Ha≤0.1) because when Hb/Ha≤0.1, the turning-direction air flow velocity component in the gap 42 is larger than 0.9 so that coarse particles are little mixed with product fine powder.

Incidentally, to avoid mechanical contact with the top plate 27 at the time of rotation of the upper fins 36, the first gap 42 (Hb) needs to be about 2 mm. On the other hand, the practical upper limit (actually allowable limit in terms of dimensions) of the height (Ha) of the upper fins 36 is about 1000 mm. Accordingly, in the invention, the lower limit of Hb/Ha is set to be 0.001.

(Second Embodiment)

Figure 10:
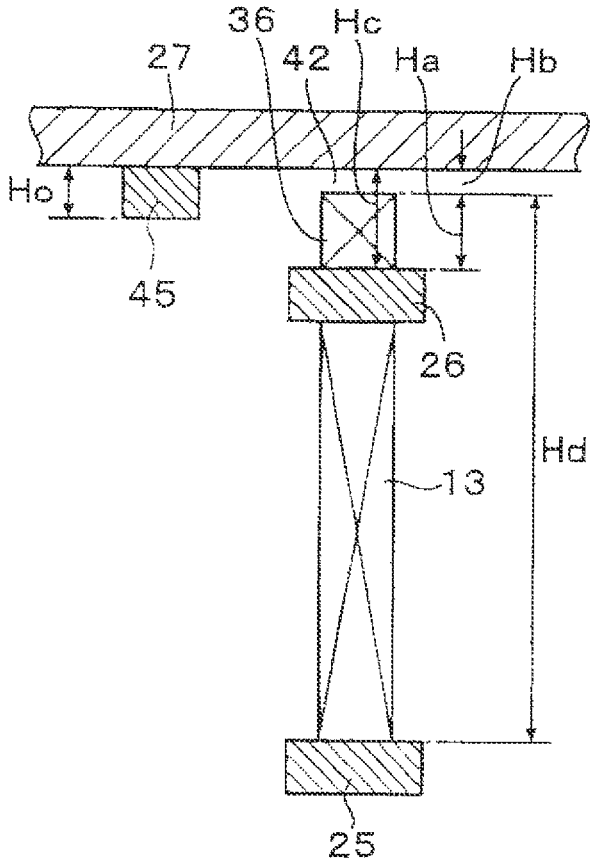
[FIG. 10] A partly enlarged schematic configuration view of a classification device according to a second embodiment of the invention.
Figure 11:
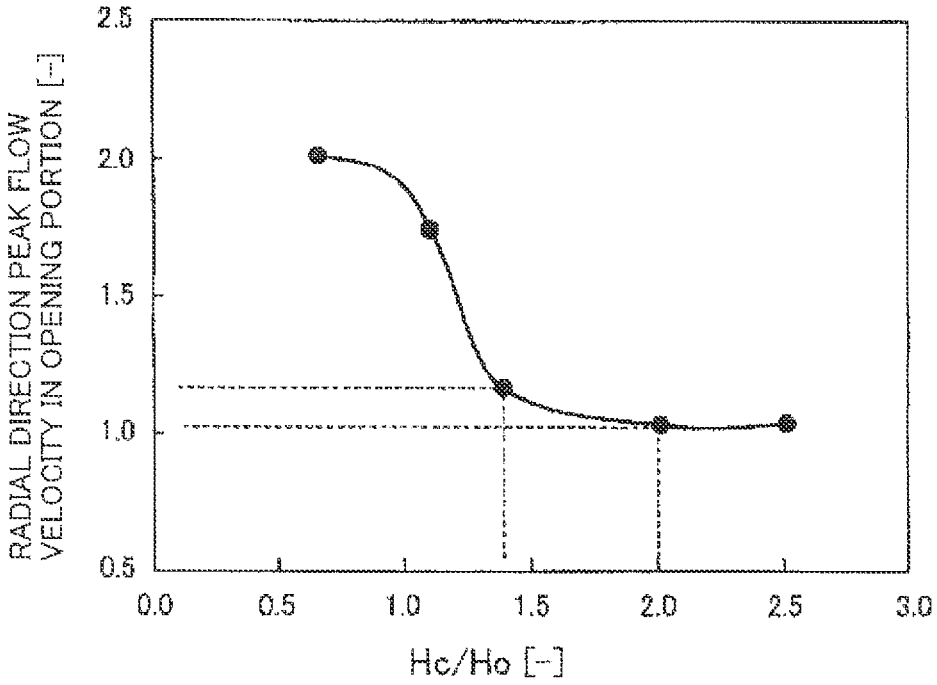
[FIG. 11] A characteristic graph showing the relationship between Hc/Ho and a peak flow velocity in a radial direction in an opening portion from a lower ring support to the top plate in this embodiment.

FIG. 10 is a partly enlarged schematic configuration view of a classification device according to a second embodiment of the invention. FIG. 11 is a flow analytic characteristic graph for explaining the proper ratio of the height of the first gap 42 to the height of the upper fins 36 in the rotating classifier.

This embodiment is different from the rotating classifier 14 according to the first embodiment shown in FIG. 8 in that coarse particle passage suppression members 45 for suppressing the passage of coarse particles in the gap 42 are disposed on the radial outside of the upper fins 36 (first gap 42). The coarse particle passage suppression members 45 are attached to the lower surface of the top plate 27 so as to be located in positions considerably nearer to the upper fins 36 (first gap 42) than the downflow forming members 30 shown in FIG. 2 or the like.

Each coarse particle passage suppression member 45 is shaped like a pillar or a plate in sectional view and plays a role of damming the particle group which intends to flow into the gap 42. The sign Ho shown in FIG. 10 expresses the height of the coarse particle passage suppression member 45 (the length from the lower surface of the top plate 27 to the lower surface of the coarse particle passage suppression member 45).

Incidentally, in this embodiment, Hb/Ha≤0.2, preferably Hb/Ha≤0.1 is set.

In FIG. 11, the horizontal axis expresses the ratio (Hc/Ho) of the height Hc of an opening portion from the upper surface of the upper ring support 26 to the lower surface of the top plate 27 to the height Ho of the coarse particle passage suppression member 45, and the vertical axis expresses the ratio of the peak value of air flow velocity in the radial direction (central direction) of the rotating classifier in an effective opening portion through which air from the lower ring support 25 to the top plate 27 can pass.

Incidentally, this test is analysis of the flow of only air. This test is performed in the condition that the downflow forming members 30 are disposed and Hb/Ha≤0.01.

As the air flow velocity in the radial direction (central direction) of the rotating classifier becomes high, the fluid resistance acting on particles in the central direction of the rotating classifier becomes strong. That is, the vertical axis in FIG. 11 expresses easiness of passage of coarse particles in the opening portion from the upper surface of the upper ring support 26 to the lower surface of the top plate 27.

In flow analysis shown in FIG. 11, it is confirmed that contraction occurs in the air flow in the opening portion from the upper surface of the upper ring support 26 to the lower surface of the top plate 27 because the distance between the upper surface of the upper ring support 26 and the lower surface of the coarse particle passage suppression member 45 is short or the upper ring support 26 and the coarse particle passage suppression member 45 overlap each other in the vertical direction when Hc/Ho is close to or smaller than 1.0. When such contraction occurs, the peak flow velocity in the opening portion increases to nearly twice of the average flow velocity.

On the other hand, as the value of Hc/Ho increases slowly from 1.0, the peak flow velocity in the radial direction of the opening portion decreases extremely. When Hc/Ho=1.4, the peak flow velocity decreases to 1.1 times as much as the average flow velocity, so that the air contraction phenomenon in the opening portion is relaxed greatly. Moreover, when Hc/Ho=2, the peak flow velocity is equalized to the average flow velocity so that the air contraction phenomenon in the opening portion is eliminated. It has been confirmed from another test that the peak flow velocity is equalized to the average flow velocity so that the air contraction phenomenon in the opening portion is eliminated even when Hc/Ho=2.5, Hc/Ho=4 or Hc/Ho=10.

From the above description, in the case of the rotating classifier 14 in which the coarse particle passage suppression members 45 are disposed on the radial outside of the upper fins 36, the passage of coarse particles can be prevented more surely because the effect due to installation of the coarse particle passage suppression members 45 can be fulfilled well while the bad influence due to installation of the coarse particle passage suppression members 45 can be removed when Hc/Ho is set to be not smaller than 1.4 (Hc/Ho≥1.4), preferably not smaller than 2.0 (Hc/Ho≥2.0).

As described above, because the air contraction phenomenon in the opening portion is eliminated when Hc/Ho is not smaller than 2, the upper limit value of Hc/Ho is not particularly set.

Incidentally, in the first and second embodiments, because each upper fin 36 has a cantilever support structure in which the lower end portion of the upper fin 36 is attached to the upper ring support 26, it is necessary in terms of attachment strength of the upper fin 36 that the ratio (Ha/Hd) of the height Ha of the upper fin 36 to the height Hd from the upper surface of the lower ring support 25 to the upper end surface of the upper fin 36 is set to be not larger than ½ (Ha/Hd≤½), preferably not larger than ⅓ (Ha/Hd≤⅓).

(Third Embodiment)

Figure 12:
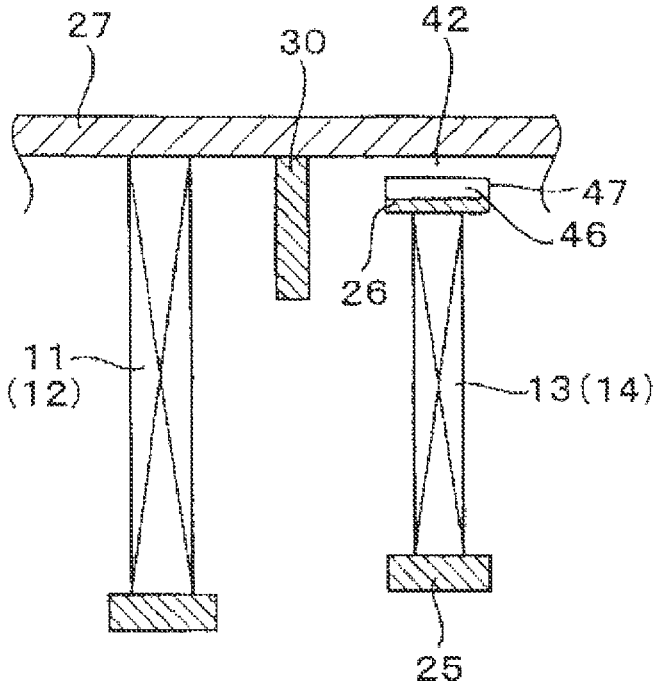
[FIG. 12] A partly enlarged schematic configuration view of a classification device according to a third embodiment of the invention.
Figure 13:
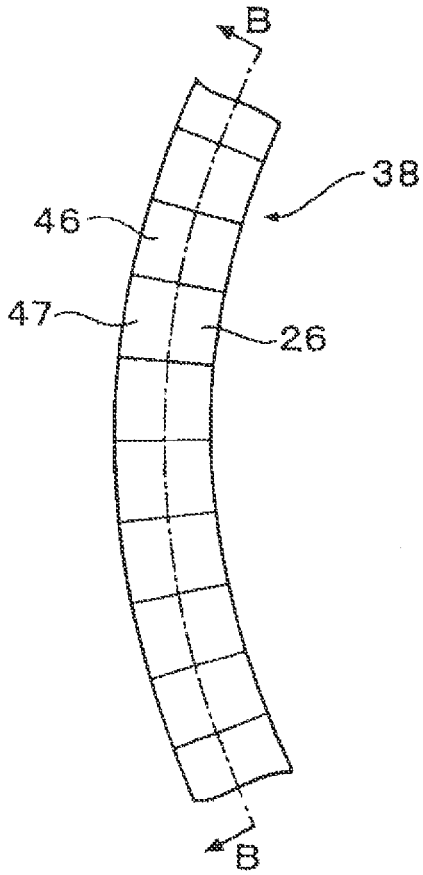
[FIG. 13] A partly plan view of an upper ring support used in the classification device.
Figure 14:
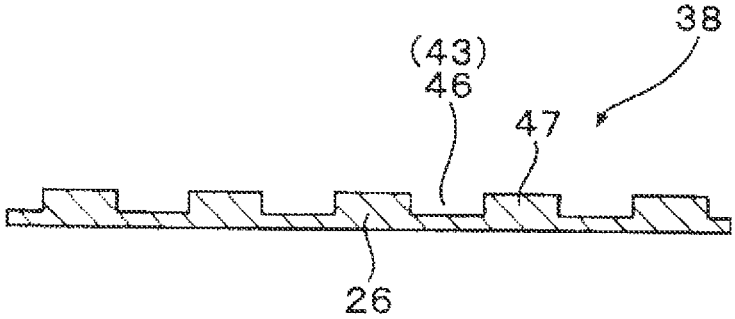
[FIG. 14] A sectional view taken along the line B-B in FIG. 13.

FIG. 12 is a partly enlarged schematic configuration view of a classification device according to a third embodiment of the invention. FIG. 13 is a partly plan view of an upper ring support 26 used in the rotating classifier 14. FIG. 14 is a sectional view taken along the line B-B in FIG. 13.

In the case of this embodiment, cut-in groove portions (concave portions) 46 are formed at substantially regular intervals along the circumferential direction in the upper portion in the direction of thickness of the upper ring support 26, so that each convex portion remaining between one groove portion 46 and another adjacent groove portion 46 is used as a fin portion 47. A large number of groove portions (concave portions) 46 and a large number of fin portions 47 (convex portions) are formed repeatedly along the circumferential direction of the upper ring support 26 to form continuous concaves and convexes to thereby form comb teeth-like protrusion portions 38.

The groove portions (concave portions) 46 pass through the upper ring support 26 from the outer circumferential end to the inner circumferential end of the upper ring support 26. Accordingly, the fin portions 47 extend from the outer circumferential end to the inner circumferential end of the upper ring support 26.

As shown in FIG. 12, the fin portion 47 (groove portion 46) side of the upper ring support 26 is set so as to face the top plate 27 side, so that a first gap 42 is formed between the upper end portion of each fin portion 47 and the lower surface of the top plate 27. The first gap 42 is connected to a second gap 43 (see FIG. 14) formed from each groove portion (concave portion) 46 of the upper ring support 26.

Although the width direction of each groove portion (concave portion) 46 faces the rotation center of the rotating classifier according to this embodiment, it is possible that each groove portion 46 is provided so as to be inclined with respect to the virtual line 34 as shown in FIG. 3 in the same manner as in the rotary classification fin 13.

Although cut-in groove portions 46 are formed in the upper ring support 26 in the case of this embodiment, an upper ring support made of a plate material may be used so that a large number of "U"-shaped cut-in portions are formed along the circumferential direction of the upper ring support and erected in the same direction to form fin portions and groove portions (concave portions) formed between the fin portions.

In the case of this embodiment, when the upper ring support 26 is provided as a structure in which the upper ring support 26 can be interchangeably attached to a body of the rotating classifier, for example, by bolts and nuts etc., a rotating classifier 14 (pulverization device) which can prevent blockages caused by biomass can be provided by a simple method of interchanging the upper ring support of the rotating classifier 14 with an upper ring support 26 according to this embodiment when biomass is classified (pulverized) in the rotating classifier 14 (pulverization device) having the conventional structure.

(Fourth Embodiment)

Figure 15:
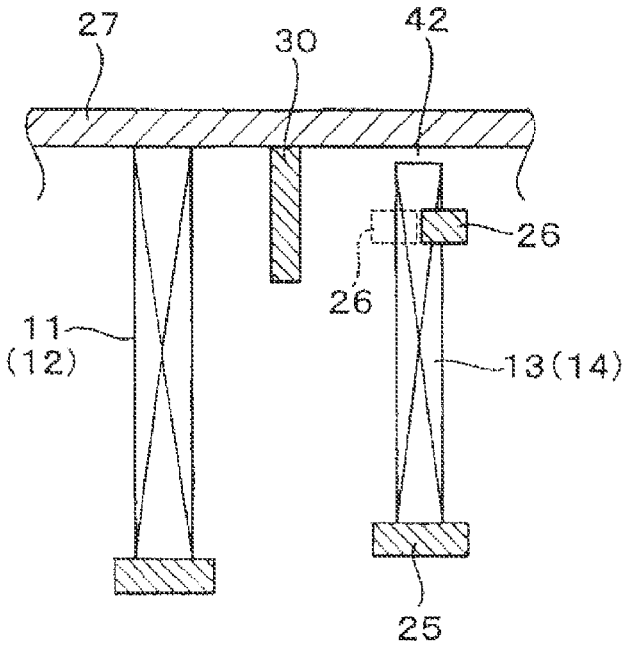
[FIG. 15] A partly enlarged schematic configuration view of a classification device according to a fourth embodiment of the invention.
Figure 16:
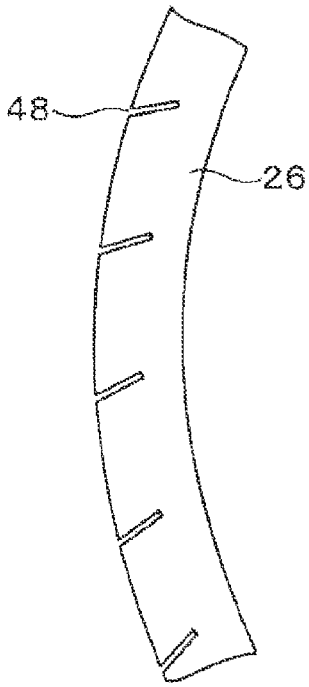
[FIG. 16] A partly plan view of an upper ring support used in the classification device.
Figure 17:
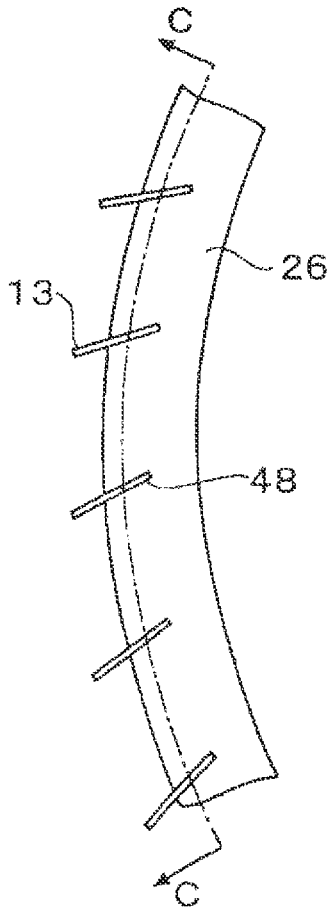
[FIG. 17] A partly plan view of rotary classification fins used in the classification device.
Figure 18:
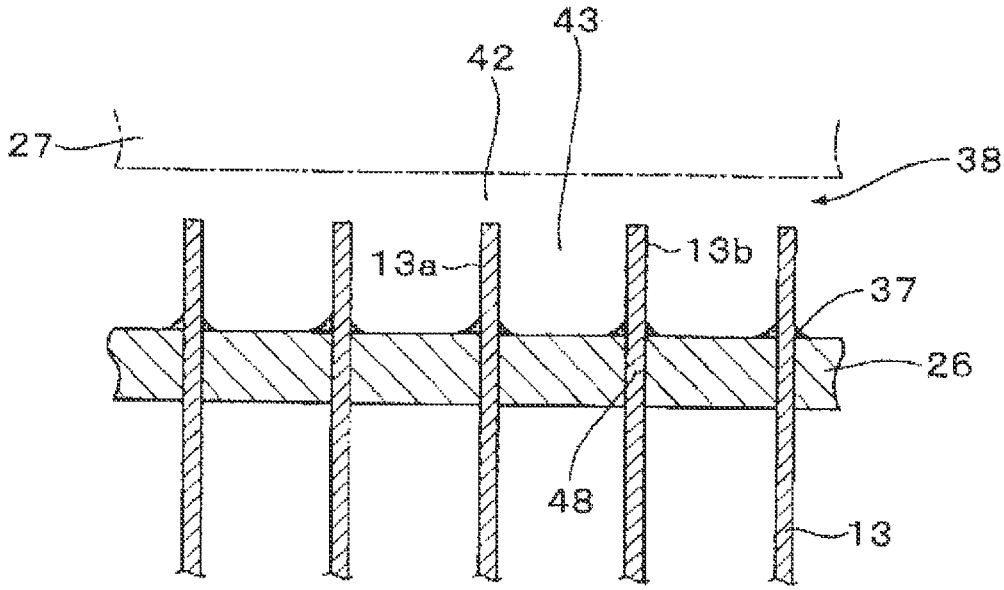
[FIG. 18] A sectional view taken along the line C-C in FIG. 17.

FIG. 15 is a partly enlarged schematic configuration view of a classification device according to a fourth embodiment of the invention. FIG. 16 is a partly plan view of an upper ring support 26 used in the rotating classifier 14. FIG. 17 is a partly plan view of rotary classification fins connected to one another by the upper ring support 26. FIG. 18 is a sectional view taken along the line C-C in FIG. 17.

In this embodiment, as shown in FIG. 15, the rotary classification fins 13 are supported and fixed by the lower ring support 25 and the upper ring support 26. Upper end portions of the rotary classification fins 13 pass through the upper ring support 26 and extend to the vicinity of the lower surface of the top plate 27. Portions protruding upward from the upper ring support 26 are equivalent to the upper fins 36 described in the first embodiment.

In this embodiment, as shown in FIG. 16, inclined cut-in grooves 48 are formed at regular intervals in the outer circumferential portion of the upper ring support 26. Side end portions of the rotary classification fins 13 are inserted in the cut-in grooves 48 respectively and fixed by welding 37 (see FIG. 18).

As shown in FIG. 18, the upper end portion of each rotary classification fin 13 faces the lower surface of the top plate 27 through a first gap 42. The first gap 42 is connected to a second gap 43 formed between one rotary classification fin 13*a* and another rotary classification fin 13*b* adjacent thereto. Comb teeth-like protrusion portions 38 are formed respectively from the upper ring support 26 and the upper end portions of the rotary classification fins 13 protruding upward from the upper ring support 26.

Although the upper ring support 26 is disposed on the radial inner side of the rotary classification fins 13 in this embodiment, the upper ring support 26 may be disposed on the radial outer side of the rotary classification fins 13 as represented by the dotted line in FIG. 15 or grooves passing through the upper ring support 26 vertically may be formed at regular intervals in the upper ring support 26 so that the upper end portions of the rotary classification fins 13 can be inserted and fixed into the through-grooves respectively.

(Fifth Embodiment)

Figure 19:
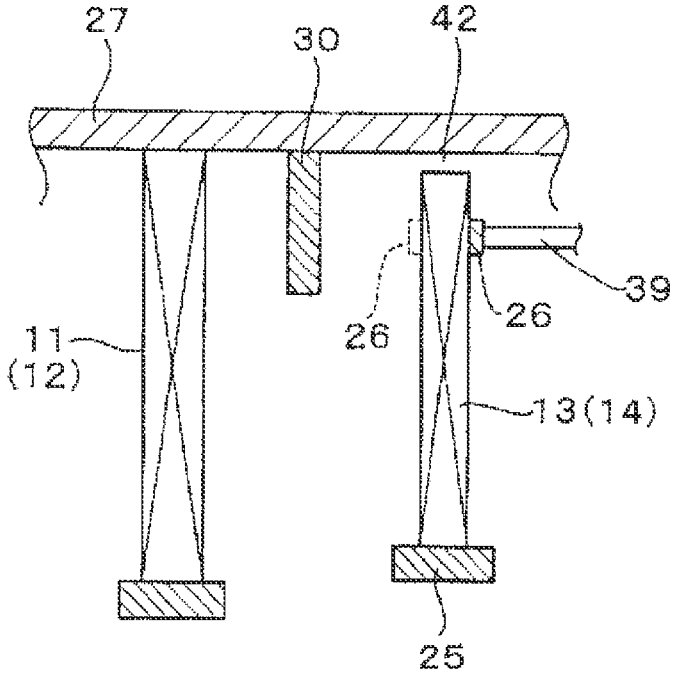
[FIG. 19] A partly enlarged schematic configuration view of a classification device according to a fifth embodiment of the invention.

FIG. 19 is a partly enlarged schematic configuration view of a classification device according to a fifth embodiment of the invention.

In this embodiment, as shown in the drawing, the structure is provided in such a manner that an upper ring support 26 shaped cylindrically is used so that upper end portions of rotary classification fins 13 are connected and fixed to one another by the upper ring support 26.

The upper ring support 26 shaped cylindrically may be disposed on the radial inner side of the rotary classification fins 13 as represented by the solid line or may be disposed on the radial outer side of the rotary classification fins 13 as represented by the dotted line. When the upper ring support 26 is disposed on the radial inner side of the rotary classification fins 13, outer end portions of connector bars 39 connecting the rotary classification fins 13 to the rotary shaft 23 may be connected to the upper ring support 26.

In the aforementioned fourth and fifth embodiments, part of the rotary classification fins 13 serve also as upper fins 36 in the first embodiment, so that the number of components can be reduced and simplification of production can be attained. Moreover, these embodiments are suitable for a rotating classifier 14 having no sufficient space in the height direction, in other words, reduction in height of the rotating classifier 14 can be attained.

Also in the aforementioned third to fifth embodiments, the coarse particle passage suppression members 45 can be disposed on the outside of the first gap 42. Also in the third to fifth embodiments, $Hb/Ha \leq 0.2$, preferably $Hb/Ha \leq 0.1$, $Hc/Ho \geq 1.4$, preferably $Hc/Ho \geq 2.0$, and $Ha/Hd \leq 1/2$, preferably $Ha/Hd \leq 1/3$ can be used.

Although description about the case of the classifier in which the downflow forming members 30 are disposed between the fixed classification fins 11 and the rotary classification fins 13 has been made in the respective embodiments, the invention can be also applied to a classifier in which the downflow forming members 30 are not disposed.

Although the respective embodiments have shown an example where the top plate 27, for example, disposed horizontally is used as a fixed member through which the rotary shaft 23 passes as shown in FIG. 1, the invention is not limited thereto as long as the member is fixed to the rotary classification fins.

(Sixth Embodiment)

Figure 20:
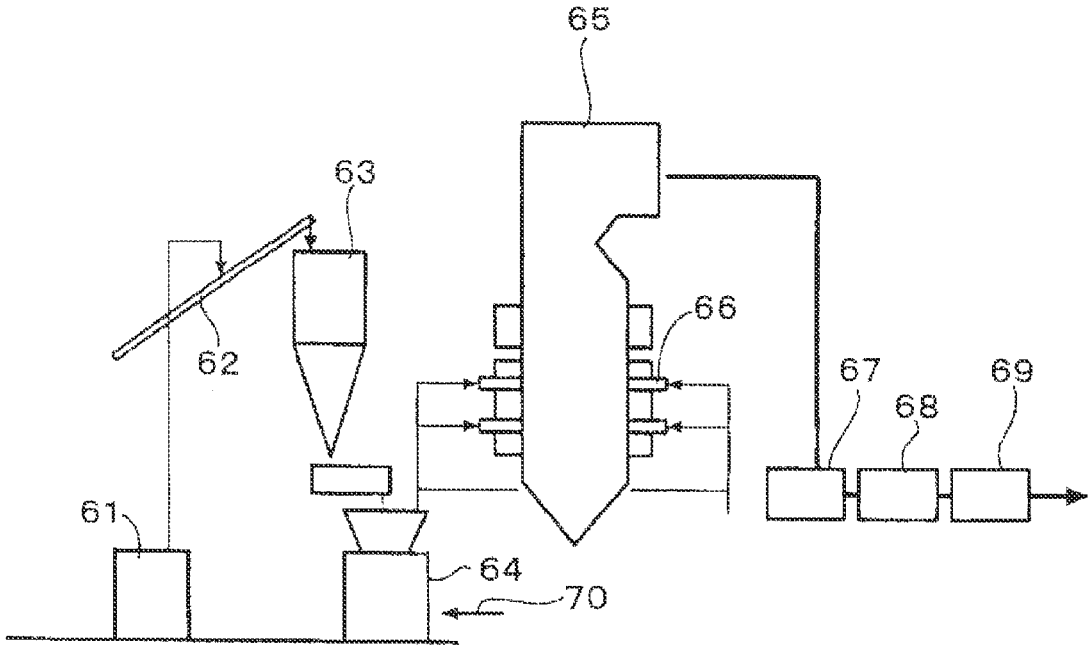
[FIG. 20] A schematic configuration view of a coal-fired boiler plant according to a sixth embodiment of the invention.

FIG. 20 is a schematic configuration view of a coal-fired boiler plant according to a sixth embodiment of the invention.

In the drawing, pellet-like or chip-like woody biomass stored in a biomass silo 61 is fed onto a raw coal carrying conveyor 62 for carrying raw coal, and put together with raw coal into a coal bunker 63.

The system is provided in such a manner that a mixture of raw coal and biomass is pulverized and mixed according to a predetermined size by a coal/biomass pulverization device 64 so that the mixed powder of these is classified and then fed to a coal/biomass mixed combustion burner 66 of a coal-fired boiler 65 and burned in a furnace.

An exhaust gas discharged from the coal-fired boiler 65 is cleaned up through a denitration device 67, an air preheater 68, an electrical dust collector 69, etc. and released from a not-shown chimney to the atmosphere. In the drawing, the sign 70 designates high-temperature primary air used for drying coal and biomass and carrying the mixed powder thereof.

(Seventh Embodiment)

Figure 21:
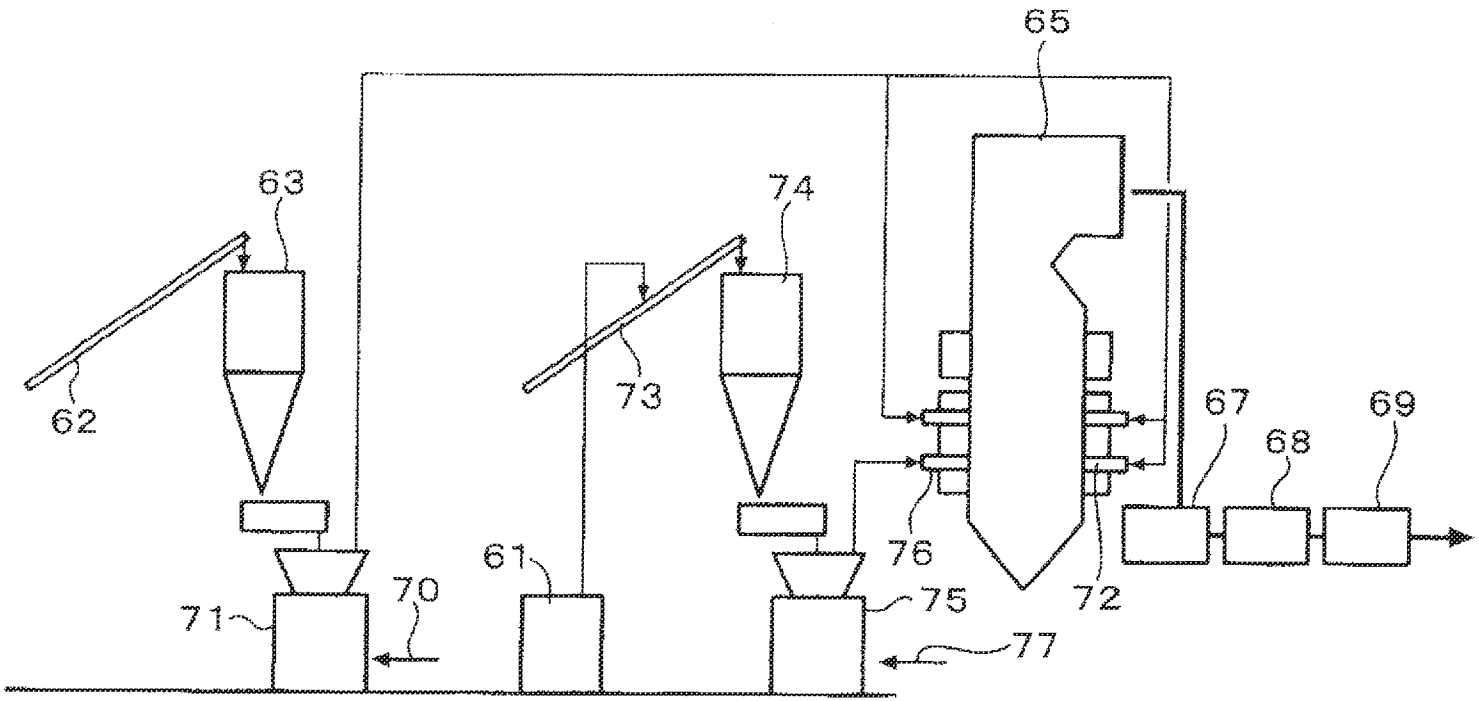
[FIG. 21] A schematic configuration view of a coal-fired boiler plant according to a seventh embodiment of the invention.

FIG. 21 is a schematic configuration view of a coal-fired boiler plant according to a seventh embodiment of the invention.

In the case of this embodiment, raw coal is put into a coal bunker 63 by a raw coal carrying conveyor 62, pulverized and classified according to a predetermined size by a first pulverization device 71, fed to a powdered coal burner 72 of a coal-fired boiler 65 and burned in a furnace.

On the other hand, pellet-like or briquette-like biomass stored in a biomass silo 61 is put into a biomass bunker 74 by a biomass carrying conveyor 73. The system is provided in such a manner that the biomass is pulverized and classified according to a predetermined size by a second pulverization device 75 and then fed to a biomass burner 76 of the coal-fired boiler 65 and burned in a furnace. In the drawing, the sign 77 designates a high-temperature exhaust gas which is used for drying biomass and carrying the biomass.

The coal/biomass pulverization device 64 in the sixth embodiment and the second pulverization device 75 in the seventh embodiment are configured as shown in FIG. 1.

In the coal-fired boiler plant according to these embodiments, biomass excellent in storability can be burned as secondary fuel so that a denitration effect in the furnace can be improved to thereby contribute to high efficiency, safety and $CO_2$ emission reduction (global warming prevention).

Although massive biomass of about 5-50 mm called "pellet" or "briquette" is used in the embodiments of the invention, biomass with a size of about hundreds of millimeters at maximum can be used as long as there is neither blockage of a biomass feed system nor problem in a pulverization system.

As a specific material, woody material derived from wood or timber or combustible material derived from plants such as coconut shells or herbaceous plants is a typical example. However, any material can be used regardless of raw material as long as the material is shaped like massive matter such as "pellet" or "briquet".

In addition, the mixture ratio of biomass to coal can be set in a wide range from the condition that the mixture ratio is infinitely close to zero to the condition that biomass occupies all.

REFERENCE SIGNS LIST

3 . . . rotary table, 8 . . . pulverization roller, 9 . . . raw material feed pipe, 10 . . . pulverization target, 11 . . . fixed classification fin, 12 . . . fixed classifier, 13 . . . rotary classification fin, 13A . . . inner end portion of the rotary classification fin, 13B . . . outer end portion of the rotary classification fin, 14 . . . rotating classifier, 15 . . . recovery cone, 16 . . . throat, 17 . . . mill casing, 18 . . . carrying gas, 19 . . . pulverized matter, 20 . . . fine particle, 21 . . . coarse particle, 22 . . . feed pipe, 23 . . . rotary shaft, 24 . . . classification motor, 25 . . . lower ring support, 26 . . . upper ring support, 27 . . . top plate, 30 . . . downflow forming member, 31 . . . particle group, 34 . . . virtual line, 35 . . . attachment groove, 36 . . . upper fin, 37 . . . welding, 38 . . . comb teeth-like protrusion portion, 39 . . . connector bar, 40 . . . blocking plate, 41 . . . classification chamber, 42 . . . first gap, 43 . . . second gap, 44 . . . space portion, 45 . . . coarse particle passage suppression member, 46 . . . groove portion, 47 . . . fin portion, 48 . . . cut-in groove, 64 . . . coal/biomass pulverization device, 65 . . . coal-fired boiler, 66 . . . coal/biomass mixed combustion burner, 71 . . . first pulverization device, 72 . . . powdered coal burner, 75 . . . second pulverization device, 76 . . . biomass burner, O . . . rotation center of the rotating classifier, X . . . rotating direction of the rotating classifier, θ . . . inclination angle of the rotary classification fin.

The invention claimed is:

1. A rotating classifier comprising:

a classifier motor;

a rotary shaft which is disposed vertically and driven to rotate by the classifier motor;

a fixed member which is disposed horizontally so that the rotary shaft passes through the fixed member;

support members which are shaped annularly in plan view and disposed below the fixed member and at a distance radially outside the rotary shaft;

a large number of rotary classification fins which are fixed to the support members at intervals in a circumferential direction of the support members; and connection members which connect the rotary classification fins to the rotary shaft, the rotary classification fins being rotated by the classifier motor so that a particle group carried by an air flow is classified by centrifugal force of the rotary classification fins; characterized in that:

comb teeth-like protrusion portions which protrude toward the fixed member side at intervals along a circumferential direction of the rotary classification fins are provided on top of the rotary classification fins;

a first gap is provided between an upper end portion of each of the protrusion portions and a lower surface of the fixed member;

a coarse particle passage suppression ring is attached to the lower surface of the fixed member and located radially outside the protrusion portions so that the protrusion portions are surrounded by the coarse particle passage suppression ring;

the ratio (Hb/Ha) of Hb to Ha is set to be not larger than 0.2 when Ha is the height of each protrusion portion and Hb is the height of the first gap; and the ratio (Hc/Ho) of Hc to Ho is set to be not smaller than 1.4 when Ho is the length from the lower surface of the fixed member to a lower surface of the coarse particle passage suppression ring and Hc is the height from a lower end of each protrusion portion to the lower surface of the fixed member.

2. A rotating classifier according to claim 1, wherein:

the ratio (Hb/Ha) is set to be not larger than 0.1, and the ratio (Hc/Ho) is set to be not smaller than 2.

3. A rotating classifier according to claim 1, wherein:

the protrusion portions are formed by extending the rotary classification fins toward the fixed member side;

the rotary classification fins are connected and fixed to one another by a lower annular support member disposed in a position corresponding to a lower portion of each of the rotary classification fins and an upper annular support member disposed above the lower annular support member; and cut-in grooves or through-holes are formed in the upper annular support member so that upper portions of the rotary classification fins are connected and fixed to one another by the upper annular support member through the cut-in grooves or through-holes.

4. A rotating classifier according to claim 3, wherein:

the protrusion portions are formed from the upper annular support member and a large number of upper fins provided so as to be erected from the upper annular support member toward the fixed member side, or formed by forming a large number of groove portions in an upper portion of the upper annular support member; and a width direction of each rotary classification fin is inclined with respect to a virtual line connecting a radially inner end of the rotary classification fin and a rotation center of the rotating classifier to each other so that a radially outer end of the rotary classification fin is separated from the virtual line, and a width direction of each of the upper fins or protrusive stripes formed between the groove portions on the upper annular support member faces the rotation center of the rotating classifier.

5. A rotating classifier according to claim 2, wherein:

the protrusion portions are formed by extending the rotary classification fins toward the fixed member side;

the rotary classification fins are connected and fixed to one another by a lower annular support member disposed in a position corresponding to a lower portion of each of the rotary classification fins and an upper annular support member disposed above the lower annular support member; and cut-in grooves or through-holes are formed in the upper annular support member so that upper portions of the rotary classification fins are connected and fixed to one another by the upper annular support member through the cut-in grooves or through-holes.

6. A rotating classifier according to claim 5, wherein:

the protrusion portions are formed from the upper annular support member and a large number of upper fins provided so as to be erected from the upper annular support member toward the fixed member side, or formed by forming a large number of groove portions in an upper portion of the upper annular support member; and a width direction of each rotary classification fin is inclined with respect to a virtual line connecting a radially inner end of the rotary classification fin and a rotation center of the rotating classifier to each other so that a radially outer end of the rotary classification fin is separated from the virtual line, and a width direction of each of the upper fins or protrusive stripes formed between the groove portions on the upper annular support member faces the rotation center of the rotating classifier.

7. A rotating classifier comprising:

a classifier motor;

a rotary shaft which is disposed vertically and driven to rotate by the classifier motor;

a fixed member which is disposed horizontally so that the rotary shaft passes through the fixed member;

support members which are shaped annularly in plan view and disposed below the fixed member and at a distance radially outside the rotary shaft;

a large number of rotary classification fins which are fixed to the support members at intervals in a circumferential direction of the support members; and connection members which connect the rotary classification fins to the rotary shaft, the rotary classification fins being rotated by the classifier motor so that a particle group carried by an air flow is classified by centrifugal force of the rotary classification fins; characterized in that:

comb teeth-like protrusion portions which protrude toward the fixed member side at intervals along a circumferential direction of the rotary classification fins are provided on top of the rotary classification fins;

a first gap is provided between an upper end portion of each of the protrusion portions and a lower surface of the fixed member;

a second gap formed between each of the protrusion portions and another protrusion portion adjacent to the protrusion portion is connected to the first gap;

a turning-direction velocity component having the same direction as a direction of rotation of the rotary classification fins is added to an air stream flowing in gaps of the protrusion portions through the first gap and the second gap due to rotation of the rotary classification fins;

the annular support members have a lower annular support member which connects and fixes lower portions of the rotary classification fins to one another, and an upper annular support member which is disposed above the lower annular support member and connects and fixes the rotary classification fins to one another; and the protrusion portions are formed by forming a large number of groove portions in an upper portion of the upper annular support member.

8. A rotating classifier according to claim 7, wherein:

the groove portions on the upper annular support member are formed by cutting in the upper portion of the upper annular support member.

9. A rotating classifier according to claim 7, wherein:

the groove portions on the upper annular support member are formed by cutting and raising part of the upper annular support member.

10. A rotating classifier according to claim 7, wherein:

the protrusion portions are interchangeably attached to a body of the rotating classifier.

* * * * *